US008391507B2

(12) United States Patent
Chan et al.

(10) Patent No.: US 8,391,507 B2
(45) Date of Patent: Mar. 5, 2013

(54) SYSTEMS, METHODS, AND APPARATUS FOR DETECTION OF UNCORRELATED COMPONENT

(75) Inventors: Kwokleung Chan, San Diego, CA (US); Hyun Jin Park, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1161 days.

(21) Appl. No.: 12/201,528

(22) Filed: Aug. 29, 2008

(65) Prior Publication Data

US 2010/0046770 A1 Feb. 25, 2010

Related U.S. Application Data

(60) Provisional application No. 61/091,295, filed on Aug. 22, 2008, provisional application No. 61/091,972, filed on Aug. 26, 2008.

(51) Int. Cl.
*H04R 3/00* (2006.01)

(52) U.S. Cl. ..... 381/92

(58) Field of Classification Search ..... 381/1, 12–19, 381/92, 111, 122
See application file for complete search history.

(56) References Cited

U.S. PATENT DOCUMENTS 6,453,041 B1 * 9/2002 Eryilmaz ..... 379/392.01
6,912,178 B2 * 6/2005 Chu et al. ..... 367/123

FOREIGN PATENT DOCUMENTS

EP 1640971 A1 * 3/2006

* cited by examiner

*Primary Examiner* — Marcos D. Pizarro
*Assistant Examiner* — Sue Tang
(74) *Attorney, Agent, or Firm* — Espartaco Diaz Hidalgo

(57) ABSTRACT

Detection of an uncorrelated component in a multi-channel acoustic signal is disclosed. In one example, the detection is based on a relation between (A) a difference in energy between two channels of the signal and (B) a threshold value that is based on an estimate of background energy of the acoustic signal.

33 Claims, 18 Drawing Sheets

SYSTEMS, METHODS, AND APPARATUS FOR DETECTION OF UNCORRELATED COMPONENT

CLAIM OF PRIORITY UNDER 35 U.S.C. §119

The present Application for Patent claims priority to Provisional Application No. 61/091,295, entitled "SYSTEMS, METHODS, AND APPARATUS FOR DETECTION OF UNCORRELATED COMPONENT," filed Aug. 22, 2008, and to Provisional Application No. 61/091,972, entitled "SYSTEMS, METHODS, AND APPARATUS FOR DETECTION OF UNCORRELATED COMPONENT," filed Aug. 26, 2008, which are assigned to the assignee hereof.

BACKGROUND

1. Field

This disclosure relates to processing of acoustic signals.

2. Background

Wind noise is known to be a problem in outdoor uses of applications that use acoustic microphones, such as hearing aids, mobile phones, and outdoor recordings. In hearing aids that use directional microphones, a light breeze may cause a sound pressure level of more than 100 dB. Cross-correlation of wind noise signals from two microphones may be very low because the wind turbulence that gives rise to the noise is local to each microphone and independent among the locations of the different microphones. However, techniques that apply results of cross-correlation of signals from two microphones to detect such noise are computationally expensive. The problem of wind noise may increase with velocity of the device having the microphones (e.g., the hearing aid or mobile phone).

SUMMARY

A method of processing a multi-channel acoustic signal according to a general configuration includes calculating a difference energy value based on information from a first channel of the acoustic signal and a second channel of the acoustic signal. This method also includes calculating a threshold value based on an estimate of background energy of the acoustic signal. This method also includes, based on a relation between the difference energy value and the threshold value, detecting the presence in the multi-channel acoustic signal of a component that is substantially uncorrelated among the first and second channels. Apparatus and other means for performing such a method, and computer-readable media having executable instructions for such a method, are also disclosed herein.

An apparatus for processing a multi-channel acoustic signal according to a general configuration includes a difference signal calculator configured to calculate a difference signal based on information from a first channel of the acoustic signal and a second channel of the acoustic signal. This apparatus includes an energy calculator configured to calculate a difference energy value based on information from the difference signal, and a threshold value calculator configured to calculate a threshold value based on an estimate of background energy of the acoustic signal. This apparatus includes a comparator configured to indicate, based on a relation between the difference energy value and the threshold value, the presence in the acoustic signal of a component that is substantially uncorrelated among the first and second channels.

DETAILED DESCRIPTION

Figure 1:
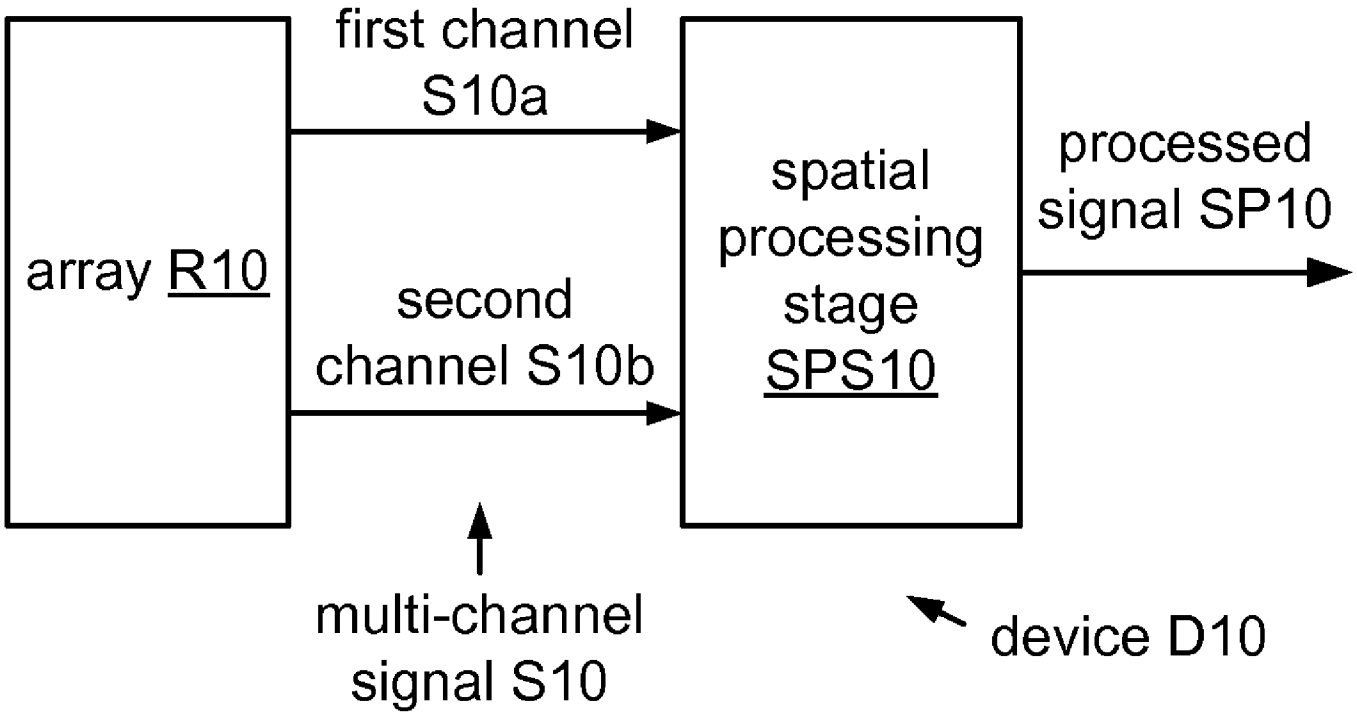
FIG. 1 shows a block diagram of a device D10 that may be configured to include an implementation of apparatus A100.

Systems, methods, and apparatus as described herein may be used to support increased intelligibility of a received (e.g., sensed) audio signal, especially in a noisy environment. Such techniques may be applied in any audio sensing and/or recording application, especially mobile or otherwise portable instances of such applications. For example, configurations as described below may reside in a wireless telephony communication system configured to employ a code-division multiple-access (CDMA) over-the-air interface. It would be understood by those skilled in the art that a configuration (e.g., a method or apparatus) having features as described herein may also reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

Unless expressly limited by its context, the term "signal" is used herein to indicate any of its ordinary meanings, including a state of a memory location (or set of memory locations) as expressed on a wire, bus, or other transmission medium. As indicated by its context, the term "acoustic signal" is used herein to indicate a pressure signal having acoustic frequency content (e.g., an air pressure signal having frequency content below about 25 kHz) and may also be used herein to indicate an electrical signal having acoustic frequency content (e.g., a digital signal representing frequency content below about 25 kHz). Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, and/or selecting from a set of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B").

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa).

It may be desirable to produce a device for receiving acoustic signals that has two or more microphones. For example, it may be desirable to produce a hearing aid, or an audio recording device, that has two or more microphones configured to receive acoustic signals. Alternatively, it may be desirable to produce a device for portable voice communications, such as a telephone handset (e.g., a cellular telephone handset) or a wired or wireless headset (e.g., a Bluetooth headset), that has two or more microphones configured to receive acoustic signals. Such a multi-microphone device may be used to reproduce and/or record a multi-channel acoustic signal (e.g., a stereo signal). Alternatively or additionally, the multiple channels of a signal as captured by the corresponding microphones may be used to support spatial processing operations, which in turn may be used to provide increased perceptual quality, such as greater noise rejection. For example, a spatial processing operation may be configured to enhance an acoustic signal arriving from a particular direction and/or to separate such a signal from other components in the multi-channel signal.

FIG. 1 shows a block diagram of an example of a device D10 for receiving acoustic signals that includes an array R10 of microphones and a spatial processing stage S10. Array R10 is configured to produce a multi-channel signal S10, each channel being based on an acoustic signal sensed by a corresponding microphone of the array. In this particular example, array R10 includes two microphones such that multi-channel signal S10 has a first channel S10*a* and a second channel S10*b*. Each microphone of array R10 may have a response that is omnidirectional, bidirectional, or unidirectional (e.g., cardioid). The various types of microphones that may be used include (without limitation) piezoelectric microphones, dynamic microphones, and electret microphones. In a device for portable voice communications, the center-to-center spacing between adjacent microphones of array R10 is typically in the range of from about 1.5 cm to about 4.5 cm, although a larger spacing (e.g., up to 10 or 15 cm) is also possible in a device such as a handset. In a hearing aid, the center-to-center spacing between adjacent microphones of array R10 may be as little as about 4 or 5 mm.

Each channel of multichannel signal S10 is a digital signal, that is to say, a sequence of samples. The microphones of array R10 may be configured to produce digital signals, or array R10 may include one or more analog-to-digital converters arranged to sample analog signals produced by the microphones. Typical sampling rates for acoustic applications include 8 kHz, 12 kHz, 16 kHz, and other frequencies in the range of from about 8 to about 16 kHz, although sampling rates as high as about 44 kHz may also be used. Array R10 may also be configured to perform one or more pre-processing operations on the microphone signals in the analog domain and/or in the digital domain, such as amplification. Such pre-processing operations may include echo cancellation, noise reduction, spectral shaping, and/or other filtering operations.

In the example of FIG. 1, device D10 also includes a spatial processing stage SPS10 that is arranged to receive multi-channel signal S10 (possibly via one or more intermediate stages, such as a filter bank). Spatial processing stage SPS10 is configured to produce a processed signal SP10 based on information from multi-channel signal S10. For example, spatial processing stage SPS10 may be configured to produce processed signal SP10 according to one or more blind source separation (BSS) and/or beamforming algorithms. Examples of such algorithms, such as independent component analysis or "ICA," independent vector analysis or "IVA," constrained ICA, and constrained IVA, are described below.

Figure 2A:
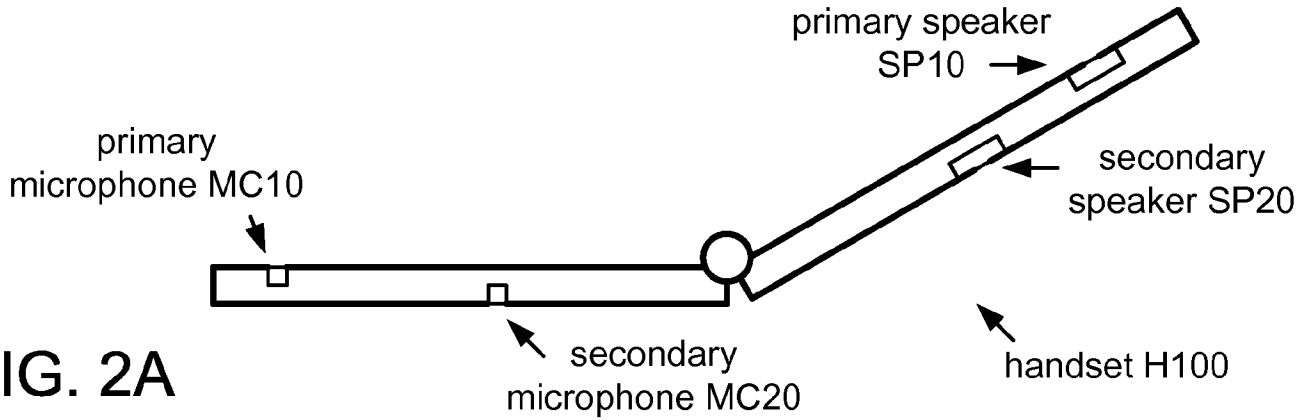
FIG. 2A shows a diagram of a handset H100 that may be implemented to include apparatus A100.
Figure 2B:
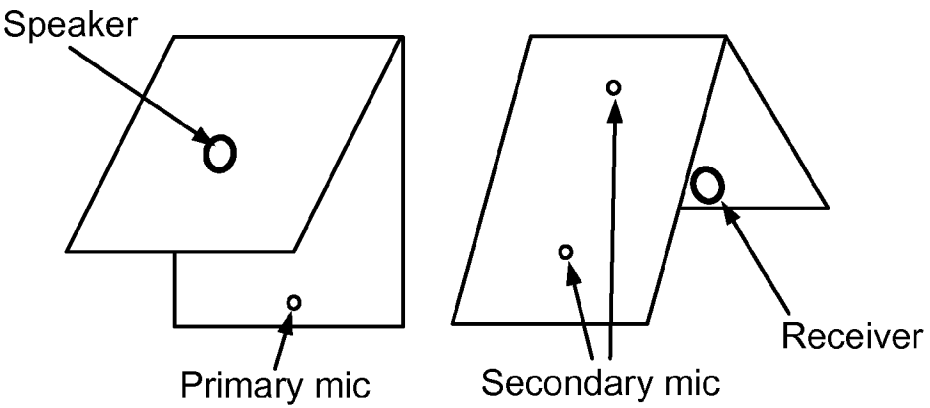
FIG. 2B shows two additional views of handset H100.

FIGS. 2A-5 show examples of devices that each include an implementation of array R10. For example, each such device may include an implementation of device D10. FIG. 2A shows a diagram of one example H100 of a cellular telephone handset in which array R10 includes two microphones MC10 and MC20. In this example, first channel S10*a* is based on a signal produced by primary microphone MC10, and second channel S10*b* is based on a signal produced by secondary microphone MC20. FIG. 2B shows two additional views of handset H100, and FIG. 3A shows a diagram of another possible operating configuration of handset H100.

Figure 3A:
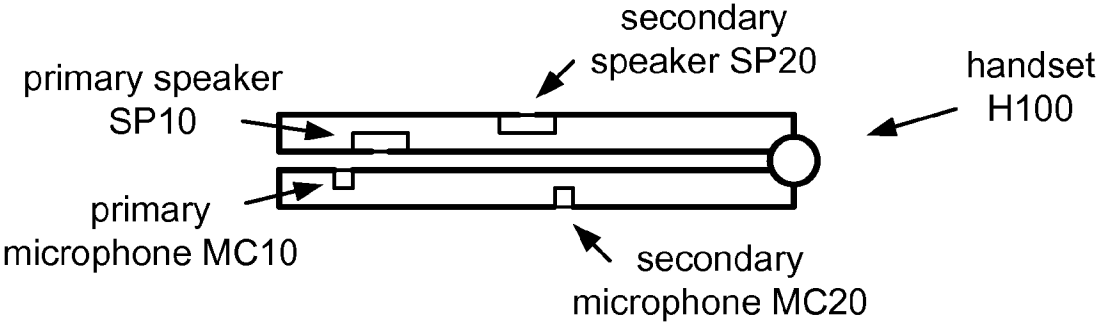
FIG. 3A shows a view of another possible operating configuration of handset H100.
Figure 3B:
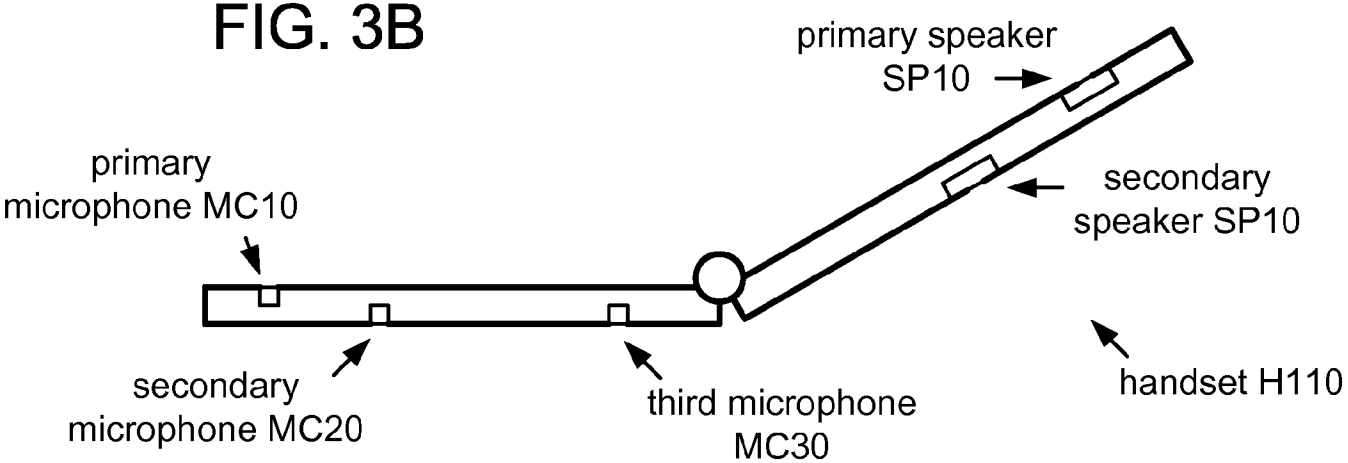
FIG. 3B shows a diagram of an implementation H110 of handset H100.

FIG. 3B shows a diagram of an implementation H110 of handset H100 in which array R10 includes a third microphone MC30. In such a case, array R10 may be configured to produce multi-channel signal S10 as a three-channel signal, each channel being based on a signal produced by a corresponding one of the three microphones. Alternatively, the channels of signal S10 may be based on different pairs of the three microphones, depending on the current operating configuration of handset H110. In an operating configuration of handset H110 as shown in FIG. 2A, for example, each channel of signal S10 may be based on a signal produced by a corresponding one of microphones MC10 and MC20, while in an operating configuration of handset H110 as shown in FIG. 3A, each channel of signal S10 may be based on a signal produced by a corresponding one of microphones MC20 and MC30.

Figure 4:
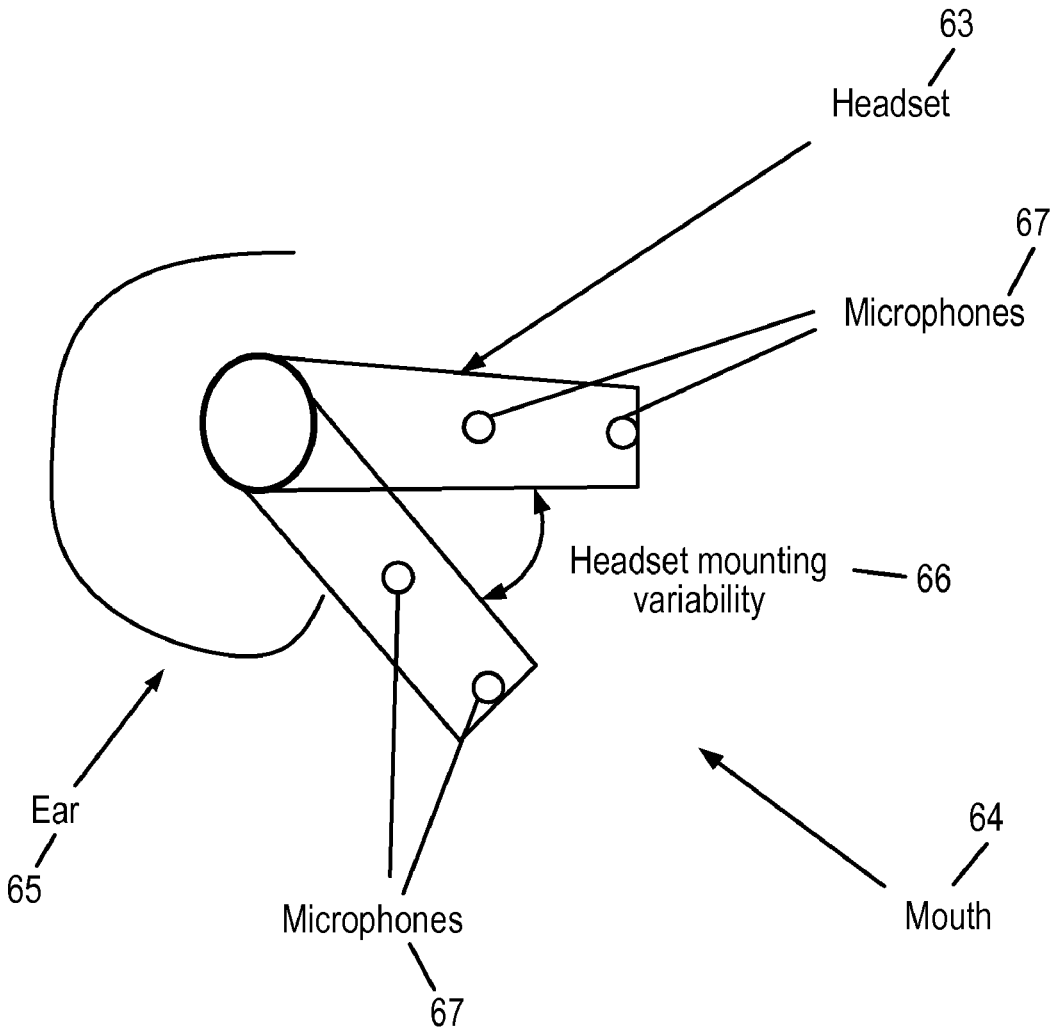
FIG. 4 shows a diagram of a headset 63 that may be implemented to include apparatus A100.

A portable device for wireless communications such as a wired or wireless earpiece or other headset may include an implementation of array R10 such that each of the first and second channels S10*a*, S10*b* is based on a signal produced by a corresponding microphone of the portable device. For example, such a device may be configured to support half- or full-duplex telephony via communication with a telephone device such as cellular telephone handset (e.g., using a version of the Bluetooth™ protocol as promulgated by the Bluetooth Special Interest Group, Inc., Bellevue, Wash.). FIG. 4 shows one example 63 of such a headset that is configured to be worn on a user's ear 65. Headset 63 has an implementation of array R10 that includes two microphones 67 are arranged in an endfire configuration with respect to the user's mouth 64.

Figure 5:
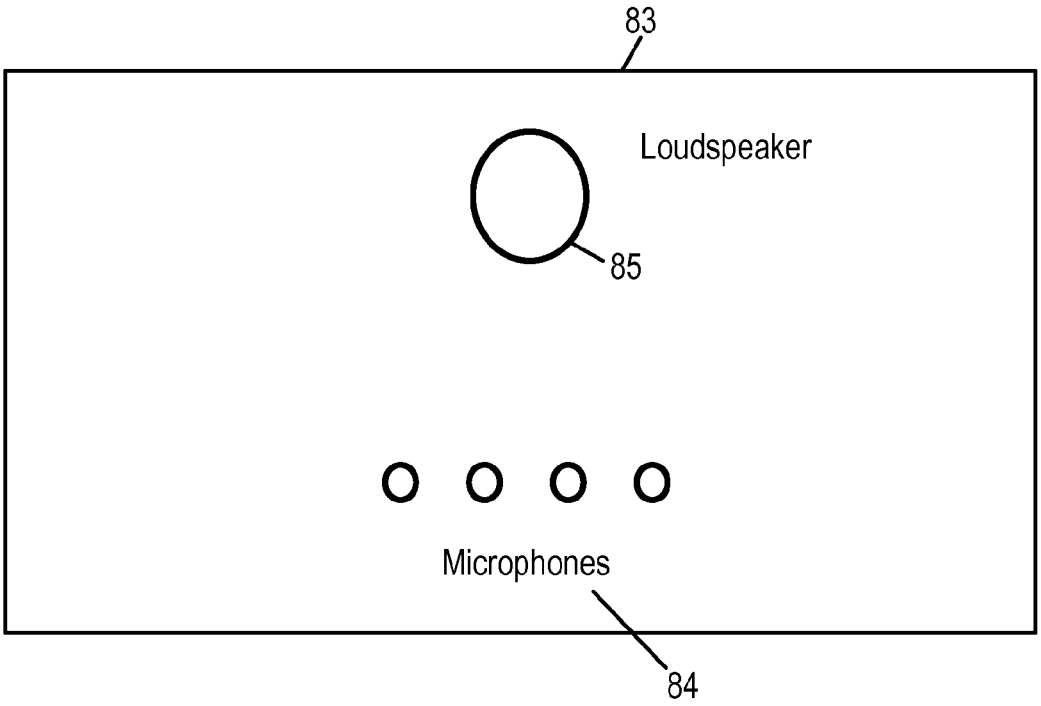
FIG. 5 shows a diagram of a hands-free car kit 83 that may be implemented to include apparatus A100.

A mobile device for wireless communications such as a hands-free car kit may include an implementation of array R10 such that each of the first and second channels S10*a*, S10*b* is based on a signal produced by a corresponding microphone of the device. In such a kit, array R10 may be mounted in, for example, the dashboard, the steering wheel, the visor, and/or the roof of the vehicle. FIG. 5 shows one example 83 of such a device in which the loudspeaker 85 is disposed broadside to an implementation 84 of array R10. It is expressly disclosed that applicability of systems, apparatus, and methods disclosed herein is not limited to the examples shown in FIGS. 2A-5.

Multi-channel signal S10 may be corrupted by a noise component that is substantially uncorrelated among the channels S10*a* and S10*b*. This noise component may include noise due to wind; noise due to breathing or blowing directly into a microphone of array R10; noise due to scratching (e.g., of the user's fingernail), tapping, and/or otherwise contacting a surface of or near to a microphone of array R10; and/or sensor or circuit noise. Such noise tends to be concentrated in low frequencies (especially noise due to wind turbulence). In this context, a component that is "substantially uncorrelated between the first and second channels" has a normalized correlation between the two channels (e.g., at zero lag) that is not greater than about zero point two (0.2). The noise component may also appear in only one of channels S10*a* and S10*b* (e.g., in less than all of the channels of multi-channel signal S10) and be substantially absent from the other channel (or channels).

The presence of such an uncorrelated component in multi-channel signal S10 may degrade the quality of a result that is based on information from that signal. For example, an uncorrelated noise component may corrupt a spatial processing operation (e.g., of stage SPS10). Amplification of such a component by more than five times has been observed in a spatial processing filter (e.g., due to white noise gain of the filter).

It may be desirable to detect the presence of an uncorrelated noise component within signal S10. For example, such detection may be used to control a filtering operation to attenuate the component and/or to disable or bypass a spatial processing operation that may be corrupted by the component. For example, it may be desirable to implement device D10 to turn off or bypass the spatial separation filters (e.g., to go to a single channel mode) when uncorrelated noise is detected, or remove the uncorrelated noise from the affected input channel (e.g., using a bandpass filter.

Figure 6:
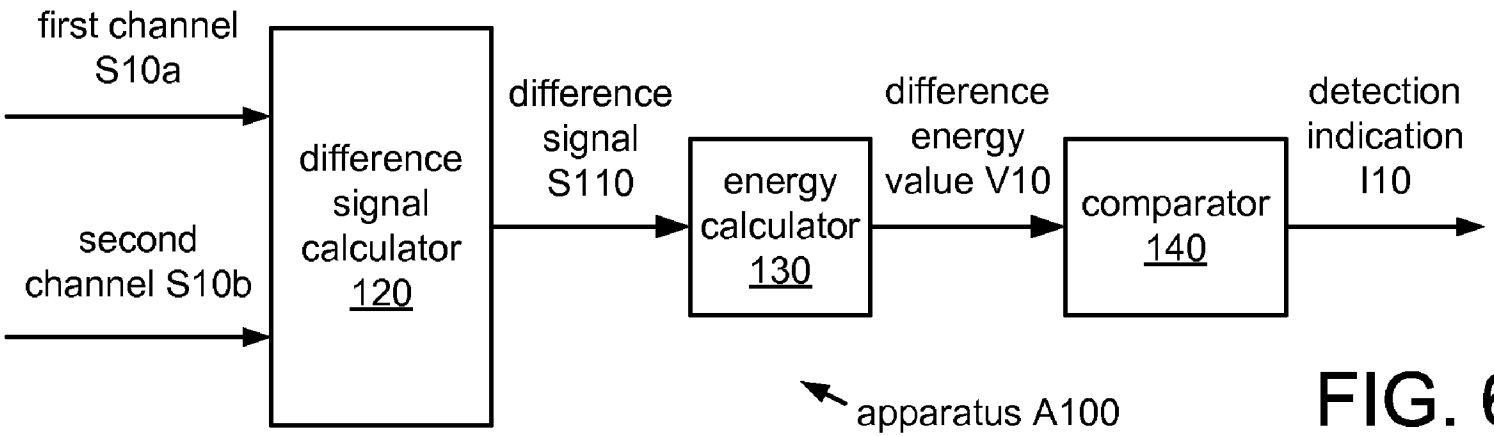
FIG. 6 shows a block diagram of an apparatus A100 according to a general configuration.

FIG. 6 shows a block diagram of an apparatus A100 according to a general configuration that includes a difference signal calculator 120, an energy calculator 130, and a comparator 140. Difference signal calculator 120 is configured to calculate a difference signal S110 that is based on information from a first channel S10*a* of a multi-channel acoustic signal (e.g., as produced by an array R10 as described above) and a second channel S10*b* of the multi-channel acoustic signal. For example, difference signal calculator 120 may be configured to calculate samples $d_i$ of difference signal S110 according to an expression such as $d_i=a_i-b_i$, $d_i=b_i-a_i$, or $d_i=|a_i-b_i|$, where i is a sample index, $a_i$ indicates samples of first channel S10*a*, and $b_i$ indicates samples of second channel S10*b*. Energy calculator 130 is configured to calculate a difference energy value V10 that is based on information from difference signal S110. Comparator 140 is configured to produce a detection indication I10 that indicates the presence of an uncorrelated component among channels S10*a* and S10*b* and is based on difference energy value V10. An implementation of apparatus A100 may be included within any of the devices as described above for receiving acoustic signals that have two or more microphones (e.g., as shown in FIGS. 2A-5) and arranged to receive channels S10*a* and S10*b* based on signals from corresponding microphones of the device (e.g., from array R10).

An implementation of apparatus A100 may be included within an implementation of device D10 as described herein. In such case, detection indication I10 may be used to control an operation of spatial processing stage SPS10. For example, it may be desirable to disable and/or bypass spatial processing operations when detection indication I10 indicates the presence of an uncorrelated component. Apparatus A100 is also generally applicable to other situations in which detection of an uncorrelated component is desired.

Figure 7A:
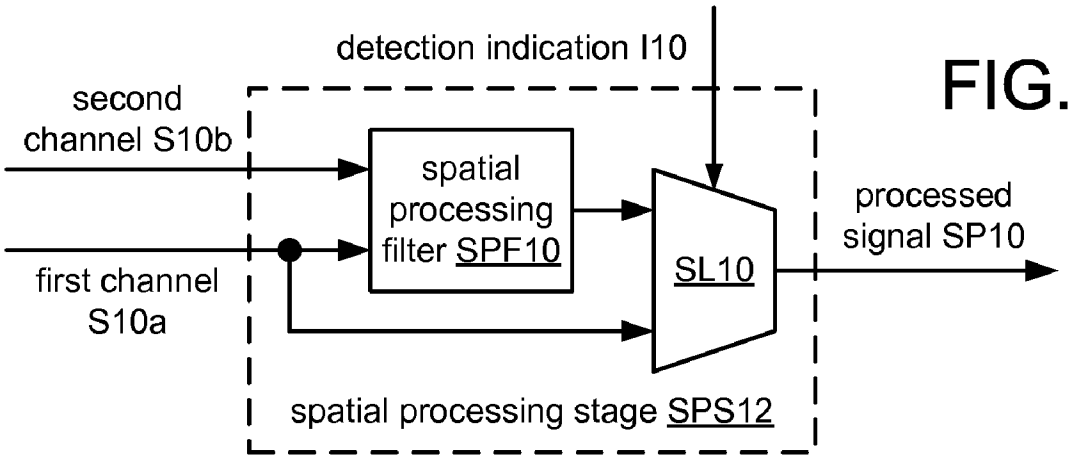
FIG. 7A shows a block diagram of an implementation SPS12 of spatial processing stage SPS10.

FIGS. 7A, 7B, 8A, 8B and 13A show examples of implementations of spatial processing stage SPS10 that may be controlled by detection indication I10. FIG. 7A shows a block diagram of an implementation SPS12 of spatial processing stage SPS10 that includes a spatial processing filter SPF10 and a selector SL10. Filter SPF10 may be implemented, for example, according to any of the BSS and/or beamforming examples described below. Selector SL10 is arranged to pass a spatially filtered signal from filter SPF10 when detection indication I10 indicates an absence of uncorrelated noise, and to bypass filter SPF10 otherwise. In this particular example, first channel S10*a* is considered to be the primary channel (e.g., is based on the signal from the microphone that receives the user's voice most directly), and selector SL10 is arranged to pass first channel S10*a* (such that stage SPS12 operates in a single-channel mode) when detection indication I10 indicates the presence of uncorrelated noise. Filter SPF10 may also be configured to be enabled or disabled according to the state of detection indication I10 (e.g., to reduce power consumption during periods when filter SPF10 is bypassed).

Figure 7B:
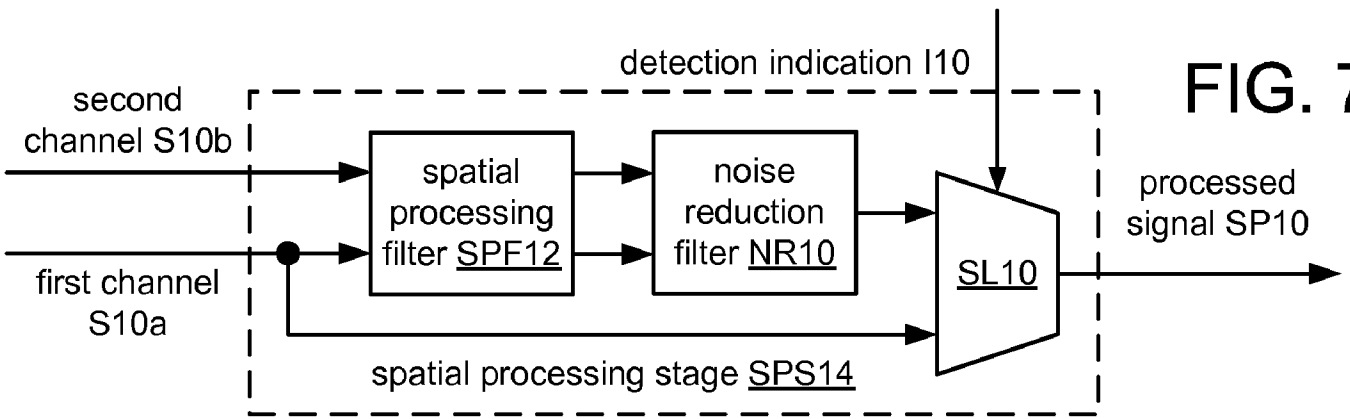
FIG. 7B shows a block diagram of an implementation SPS14 of spatial processing stage SPS10.

FIG. 7B shows a block diagram of an implementation SPS14 of spatial processing stage SPS10 that includes an implementation SPF12 of spatial processing filter SPF10 and a noise reduction filter NR10. In this example, filter SPF12 is configured to produce two output signals: (A) a combination signal, which contains both the desired information signal (e.g., the user's speech) and noise, and (B) a noise reference, which contains little or none of the energy of the desired information signal. Noise reduction filter NR10 is configured to remove noise from the combination signal, based on information from the noise reference. For example, noise reduction filter NR10 may be implemented as a Wiener filter, having coefficients that may be based on signal and noise power information from the spatially processed channels. In such case, noise reduction filter NR10 may be configured to estimate the noise spectrum based on the noise reference. Alternatively, noise reduction filter NR10 may be implemented to perform a spectral subtraction operation on the combination signal, based on a spectrum from the noise reference. Alternatively, noise reduction filter NR10 may be implemented as a Kalman filter, with noise covariance being based on the noise reference. In any of these cases, noise reduction filter NR10 may be configured to include a voice activity detection (VAD) operation, or to use a result of such an operation otherwise performed within the apparatus, to estimate noise characteristics such as spectrum and or covariance during non-speech intervals only. Such an operation may be configured to classify a frame of signal S10 as speech or non-speech based on one or more factors such as frame energy, energy in two or more different frequency bands, signal-to-noise ratio, periodicity, autocorrelation of speech and/or residual, zero-crossing rate, and/or first reflection coefficient.

Figure 8A:
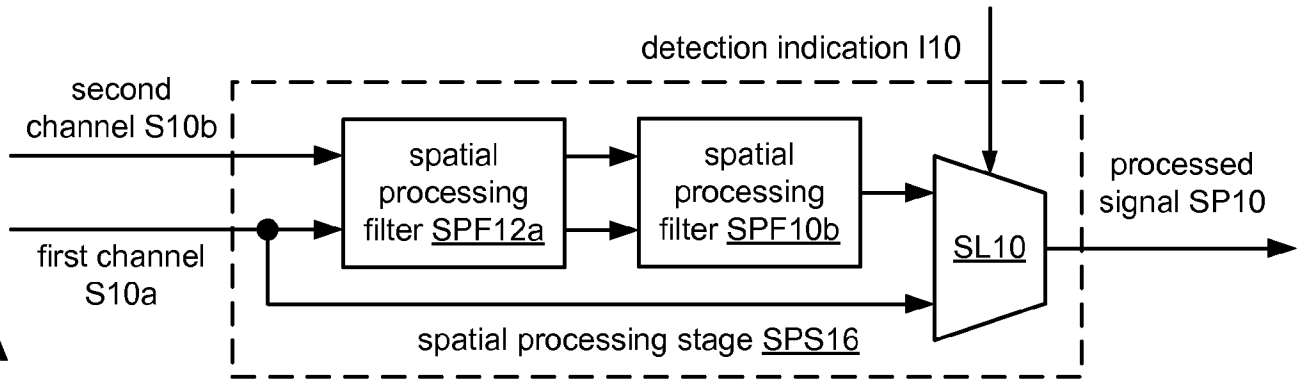
FIG. 8A shows a block diagram of an implementation SPS16 of spatial processing stage SPS10.
Figure 8B:
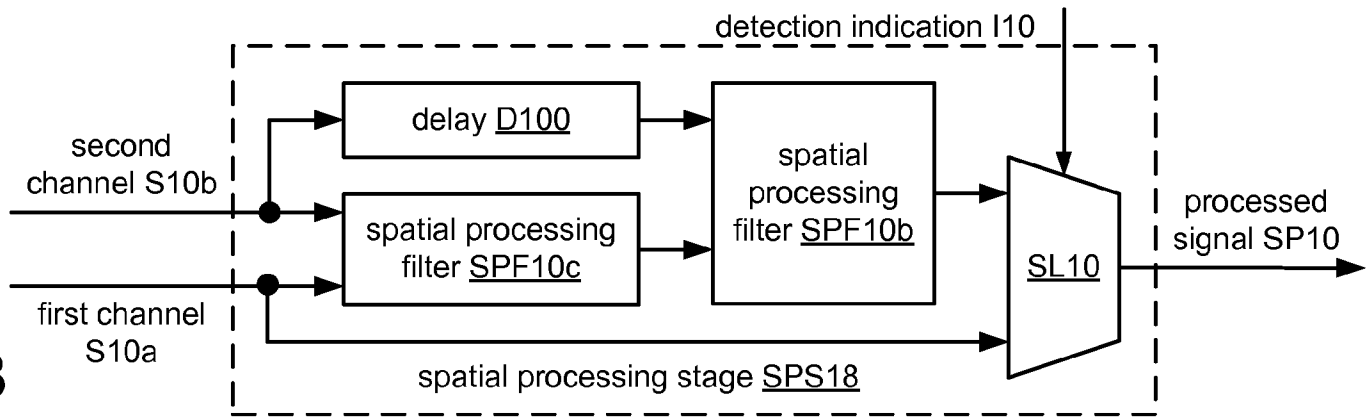
FIG. 8B shows a block diagram of an implementation SPS18 of spatial processing stage SPS10.

It may be desirable to implement filter SPF10 to have fixed coefficients, to have adaptive coefficients, or to have both fixed and adaptive coefficients. FIG. 8A shows a block diagram of an implementation SPS16 of spatial processing stage SPS10 that includes an implementation SPF12*a* of spatial processing filter SPF12 that has only fixed coefficients, and an implementation SPF10*b* of filter SPF10 that has adaptive coefficients. FIG. 8B shows a block diagram of an implementation SPS18 of spatial processing stage SPS10 that includes an implementation SPF10*c* of spatial processing filter SPF10 that produces a single output channel and an implementation SPF10*b* of filter SPF10. In this case, delay D100 may be configured to introduce a delay equal to an expected processing delay of filter SPF10*c*.

Applications of detection indication I10 to bypass, suspend, and/or disable spatial processing operations are not limited to the particular examples described above with reference to FIGS. 7A, 7B, 8A, and 8B. Such filtering principles may be combined and/or cascaded, for example, to produce other spatial processing pipelines that may operate in response to a state of detection indication I10. Such applications may also include instances of multi-channel signal S10 that have more than two channels.

Figure 9A:
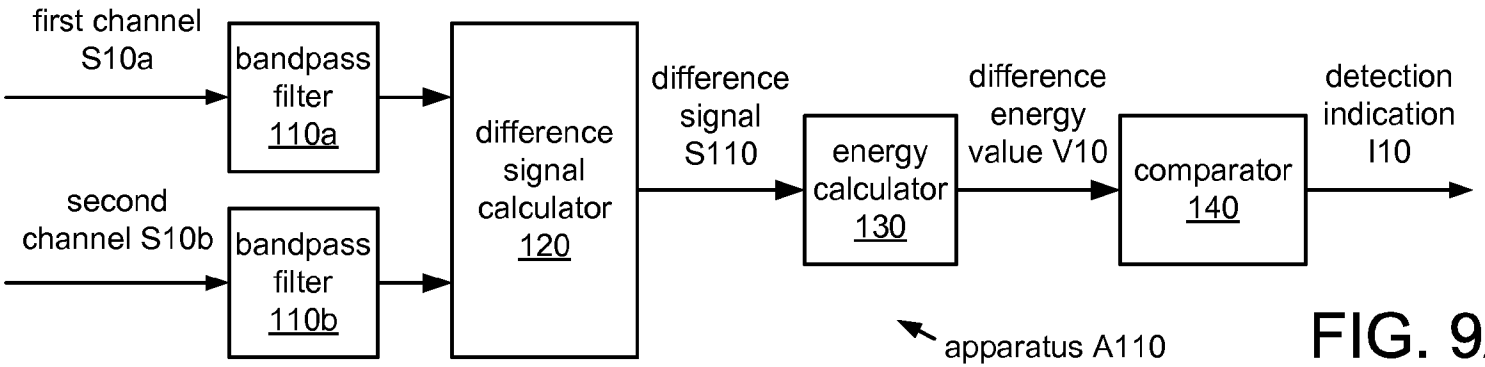
FIG. 9A shows a block diagram of an implementation A110 of apparatus A100.

FIG. 9A shows a block diagram of an implementation A110 of apparatus A100 that includes bandpass filters 110*a* and 110*b*. Bandpass filter 110*a* is configured to filter first channel S10*a*, and bandpass filter 110*b* is configured to filter second channel S10*b*. In this implementation, difference signal calculator 120 is arranged to calculate samples $d_i$ of difference signal S110 according to an expression such as $d_i=fa_i-fb_i$, $d_i=fb_i-fa_i$, or $d_i=|fa_i-fb_i|$, where i is a sample index, $fa_i$ indicates samples of first channel S10*a* as filtered by bandpass filter 110*a*, and $fb_i$ indicates samples of second channel S10*b* as filtered by bandpass filter 110*b*. In a typical example, bandpass filters 110*a* and 110*b* are each configured to lowpass filter the corresponding channel. In such case, bandpass filters 110*a* and 110*b* may be implemented as lowpass filters having a cutoff frequency in the range of from about 800 Hz to about one kHz. The energy of an uncorrelated noise component, such as wind noise, may be expected to be concentrated mainly in this lower frequency band.

In another implementation of apparatus A110, bandpass filters 110*a* and 110*b* are additionally configured to highpass filter the corresponding channel. In such case, the bandpass filters 110*a* and 110*b* may be implemented to have a highpass cutoff frequency of about 200 Hz. Such additional filtering may be expected to attenuate a low-frequency component, caused by pressure fluctuations of wind flow, that may be correlated between the channels, especially for a microphone spacing of about ten centimeters or less.

Matching the sensitivities (e.g., the gain characteristics) of the microphones of array R10 to one another may be important to obtaining a desired performance of a spatial processing operation. It may be desirable to configure apparatus A100 to perform a gain matching operation on second channel S10*b* such that difference signal S110 is based on information from the gain-matched signal (i.e., to perform the gain matching operation upstream of difference signal calculator 120). This gain matching operation may be designed to equalize the gains of the microphones upon whose outputs the first and second channels S10*a*, S10*b* are based. Such a matching operation may be configured to apply a frequency-independent gain factor (i.e., a scalar) that is fixed or variable and may also be configured to periodically update the value of the gain factor (e.g., according to an expected drift of the microphone characteristics over time). Alternatively, such a matching operation may be configured to include a frequency-dependent operation (e.g., a filtering operation). Apparatus A100 may be configured to perform the gain matching operation after bandpass filter 110*b* (e.g., as shown in FIG. 9B), before bandpass filter 110*b*, or even within bandpass filter 110*b*.

Figure 9B:
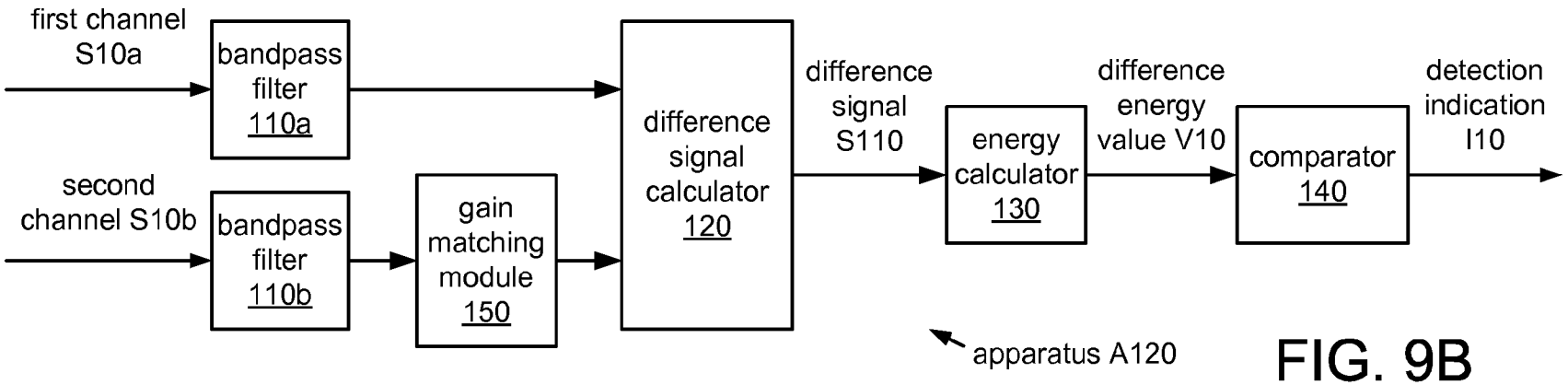
FIG. 9B shows a block diagram of an implementation A120 of apparatus A100.

FIG. 9B shows a block diagram of an implementation A120 of apparatus A100 that includes a gain matching module 150. Module 150 may be configured to multiply the filtered signal by a fixed gain factor or to apply a filter that has a fixed set of coefficients. Alternatively, module 150 may be configured to apply a gain factor or filter that varies over time. Examples of adaptive gain matching operations that may be performed by module 150 are described in U.S. Provisional Pat. Appl. No. 61/058,132, entitled "SYSTEM AND METHOD FOR AUTOMATIC GAIN MATCHING OF A PAIR OF MICROPHONES," and in U.S. Pat. No. 7,203,323 (Tashev, issued Apr. 10, 2007). Gain matching module 150 may also be configured to match phase characteristics of the corresponding microphones.

Energy calculator 130 is configured to calculate a difference energy value V10 that is based on information from difference signal S110. Energy calculator 130 may be configured to calculate a sequence of instances of difference energy value V10 such that each instance corresponds to a block of samples (also called a "frame") of difference signal S110. In such case, the frames may be overlapping (e.g., with adjacent frames overlapping by 25% or 50%) or nonoverlapping. Typical frame lengths range from about 5 or 10 milliseconds to about 40 or 50 milliseconds. In one particular example, energy calculator 130 is configured to calculate a corresponding instance of difference energy value V10 for each frame of difference signal S110, where difference signal S110 is divided into a sequence of 10-millisecond nonoverlapping frames.

Energy calculator 130 is typically configured to calculate difference energy value V10 according to an expression such as $$\sum_F d_i^2 \text{ or } \frac{1}{n}\sum_F d_i^2,$$

where F denotes the corresponding frame and $d_i$ denotes samples of difference signal S110, and n denotes the number of samples in frame F. Energy calculator 130 may also be configured to calculate difference energy value V10 by normalizing a result of such an expression by an energy of first channel S10*a* (e.g., calculated as a sum of squared samples of a signal produced by bandpass filter 110*a* over some interval, such as the current frame).

It may be desirable to configure energy calculator 130 to calculate a sequence of smoothed instances of difference energy value V10. For example, energy calculator 130 may be configured to calculate difference energy value V10 according to an expression such as $E_{sc}=(1-\alpha)E+\alpha E_{sp}$ where E is the energy value calculated (e.g., as described in the preceding paragraph) for the current frame, $E_{sp}$ is the smoothed value V10 for the previous frame, $E_{sc}$ is the smoothed value V10 for the current frame, and $\alpha$ is a smoothing factor having a value in the range of from zero (no smoothing) to about 0.999 (maximum smoothing). In such case, energy calculator 130 may be configured to normalize the value E by an energy of first channel S10*a* as described above before such smoothing or to normalize the value $E_{sc}$ by such a value after the smoothing. An energy calculation according to any of these examples is typically much less computationally expensive than a cross-correlation operation.

Comparator 140 is configured to produce a detection indication I10 that indicates the presence of an uncorrelated component among channels S10*a* and S10*b* and is based on a relation between a threshold value T1 and difference energy value V10. For example, comparator 140 may be configured to produce detection indication I10 as a binary signal that has a first state (indicating the presence of the uncorrelated component) in response to a determination that difference energy value V10 is greater than (alternatively, not less than) threshold value T1 and a second state otherwise. Threshold value T1 may be fixed (i.e., a constant) or adaptive. Detection indication I10 may be applied to enable or disable one or more spatial processing operations (e.g., as described herein with reference to FIGS. 7A, 7B, 8A, 8B, and 13A).

Figure 10A:
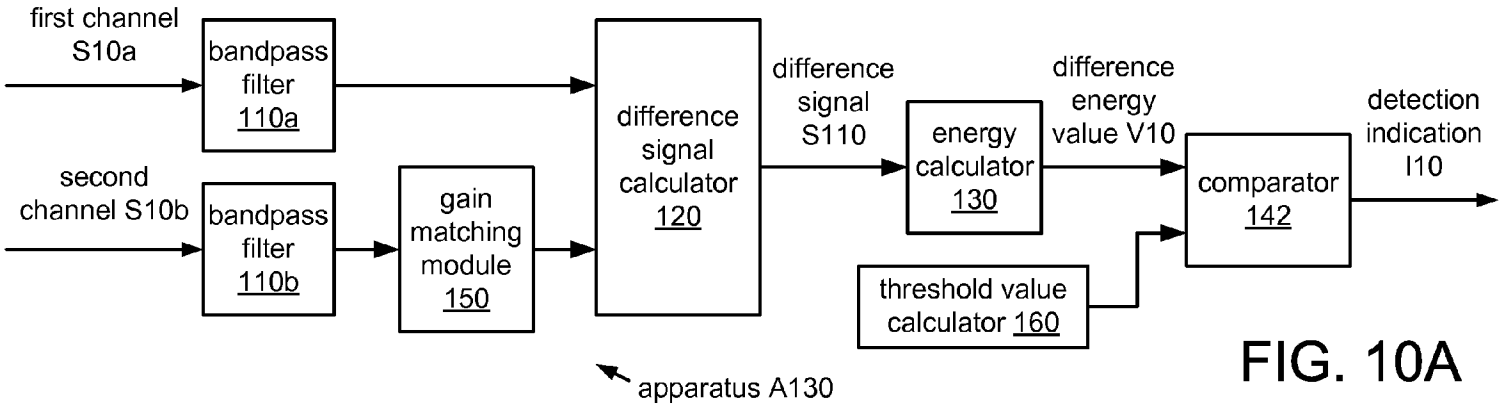
FIG. 10A shows a block diagram of an implementation A130 of apparatus A100.

FIG. 10A shows a block diagram of an implementation A130 of apparatus A100 that includes a threshold value calculator 160 and an implementation 142 of comparator 140. Threshold value calculator 160 is configured to calculate threshold value T1, and comparator 142 is configured to receive threshold value T1 and difference energy value V10 and to produce detection indication I10 based on a relation between those values as described herein. Threshold value calculator 160 is typically configured to produce threshold value T1 as a function of at least one base value $V_B$. In one example, the base value $V_B$ is an energy of first channel S10*a* (e.g., calculated as a sum of squared samples of a signal produced by bandpass filter 110*a* over some interval, such as the current frame). In another example, the base value $V_B$ is an energy of second channel S10*b* (e.g., calculated as a sum of squared samples of a signal produced by bandpass filter 110*b* or gain matching module 150 over some interval, such as the current frame). In another example, the base value $V_B$ is an average of energies of first channel S10*a* and second channel S10*b*. It may be desirable, in any of these three examples, to smooth an energy value before using it as base value $V_B$. For example, threshold value calculator 160 may be configured to calculate a smoothed value for base value $V_B$ according to an expression such as $E_{sc}=(1-\beta)E+\beta E_{sp}$, where E is the energy value calculated for the current frame, $E_{sp}$ is the smoothed value for the previous frame, $E_{sc}$ is the smoothed value to be used as base value $V_B$, and $\beta$ is a smoothing factor having a value in the range of from zero (no smoothing) to about 0.999 (maximum smoothing).

Threshold value calculator 160 is typically configured to produce threshold value T1 as a linear function of the at least one base value $V_B$. For example, threshold value calculator 160 may be configured to produce threshold value T1 according to an expression such as $T1=u(V_B+v)$, where $V_B$ denotes the base value and the factors u and v may be adjusted as desired to change the detection sensitivity. In another example, threshold value calculator 160 is configured to produce threshold value T1 as a polynomial, exponential, and/or logarithmic function of at least one base value $V_B$.

Figure 10B:
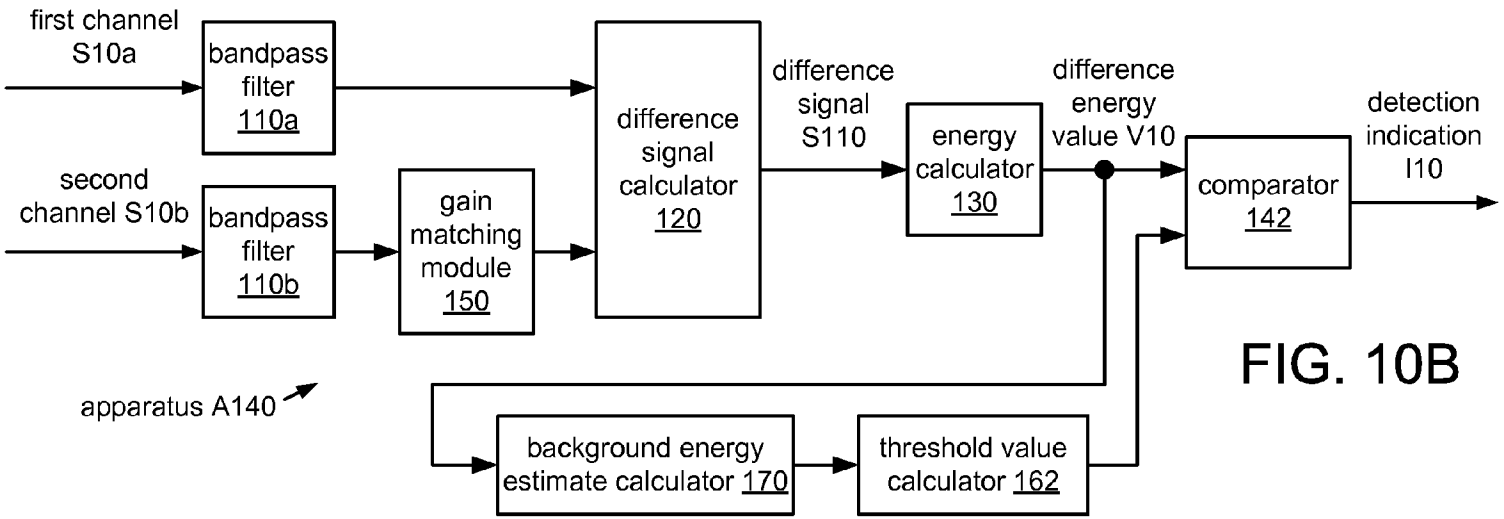
FIG. 10B shows a block diagram of an implementation A140 of apparatus A100.

Threshold value calculator 160 may be configured to produce threshold value T1 as a function (e.g., a linear function) of an estimate $E_{bkgd}$ of background energy of the speech signal. In such case, apparatus A100 may be implemented to include a background energy estimate calculator 170 that is configured to calculate $E_{bkgd}$. FIG. 10B shows a block diagram of an implementation A140 of apparatus A100 that includes such an implementation 162 of threshold value calculator 160 which is configured to receive a value of $E_{bkgd}$ as calculated by background energy estimate calculator 170.

Background energy estimate calculator 170 may be configured to calculate an initial estimate of $E_{bkgd}$ as an average of the first several values of an energy quantity (e.g., as an average of the first m values of difference energy value V10, where m typically has a value in the range of from about five, ten, twenty, or twenty-five to about fifty or one hundred). Subsequently, background energy estimate calculator 170 may be configured to calculate a new value of $E_{bkgd}$ based on a difference $\Delta_E$ between difference energy value V10 and the current value of $E_{bkgd}$ (e.g., $\Delta_E=V10-E_{bkgd}$). Background energy estimate calculator 170 may be configured to use smoothed values of difference energy value V10 for such calculation or, alternatively, to use pre-smoothed or otherwise unsmoothed values of difference energy value V10 for such calculation. In one example, calculator 170 updates $E_{bkgd}$ by performing an operation as shown in FIG. 11A. The operation includes a task T210 that compares difference $\Delta E$ to zero, and a task T220 that updates $E_{bkgd}$ if difference $\Delta_E$ is less than (alternatively, not greater than) zero. An outcome of Yes in task T210 indicates that the background level is decreasing (alternatively, not increasing). The factor F1 of task T220 typically has a value of 0.1 or less, such as 0.02.

An outcome of No in task T210 may indicate that the background level is increasing or, alternatively, that the current frame is a foreground activity. It may be desirable to distinguish between these two cases. In this example, the operation also includes a task T230, which compares difference $\Delta_E$ to a proportion of $E_{bkgd}$, and a task T240 that updates $E_{bkgd}$ if difference $\Delta_E$ is less than (alternatively, not greater than) the proportion. Such an outcome is taken to indicate that the current frame is not a foreground activity. The threshold factor T2 of task T230 typically has a value of 0.5 or less, such as 0.2, and the factor F2 of task T240 typically has a value of 0.1 or less, such as 0.01.

Figure 11B:
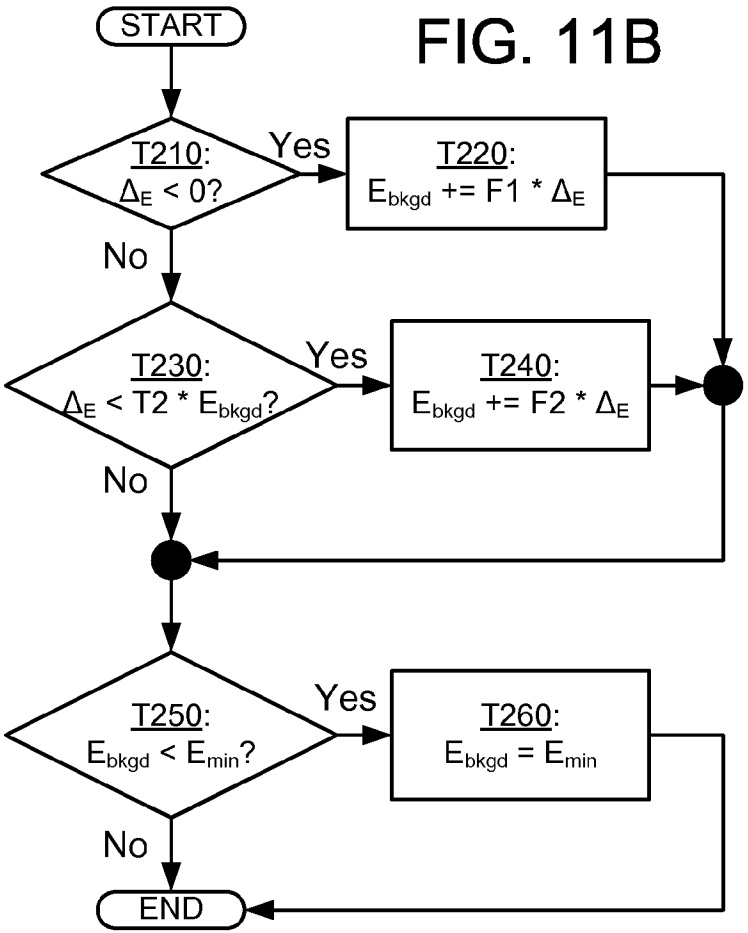
FIG. 11B shows a flowchart of an operation O220 that may be performed by another implementation of background energy estimate calculator 170.
Figure 11A:
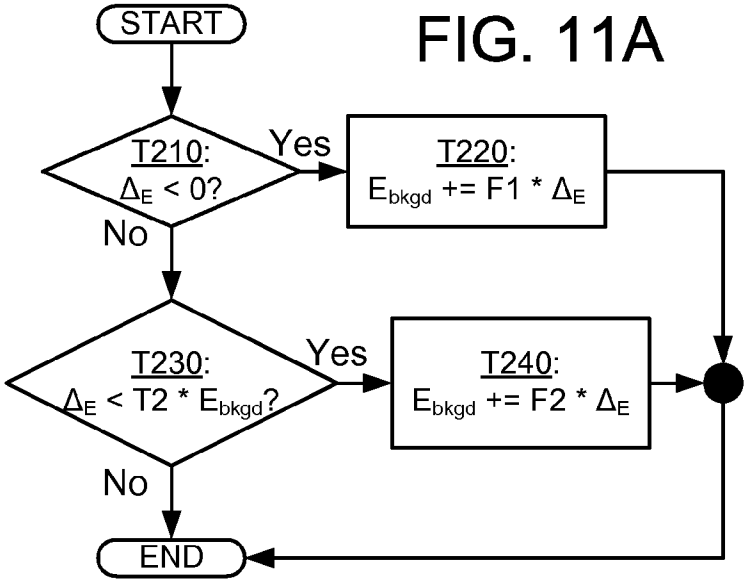
FIG. 11A shows a flowchart of an operation O210 that may be performed by an implementation of background energy estimate calculator 170.

In another example, calculator 170 updates $E_{bkgd}$ by performing an operation as shown in FIG. 11B. This operation also includes a task T250, which compares $E_{bkgd}$ to a minimum energy value $E_{min}$, and a task T260 that updates $E_{bkgd}$ if it is less than (alternatively, not greater than) $E_{min}$. In one example, $E_{min}$ is calculated as the minimum value of difference energy value V10 over the N most recent frames, where N is typically a value in the range of from about 50 to about 400 (e.g., 200). For a case in which energy calculator 130 is configured to produce difference energy value V10 as a smoothed value as described above, it may be desirable to use the pre-smoothed difference energy values for each frame (rather than the smoothed values) to update $E_{min}$. Alternatively, it may be desirable in such a case to use the smoothed difference energy values for each frame to update $E_{min}$.

It may be desirable to configure comparator 140 (or comparator 142) to produce detection indication I10 as a combination of observations over time. In one such example, comparator 140 is configured to produce detection indication I10 to have the first state (i.e., indicating the presence of the uncorrelated component) if difference energy value V10 is greater than (alternatively, not less than) threshold value T1 for each of the most recent p frames and to have the second state otherwise. In such case, the value of p may be in the range of from about two or ten or twenty to about fifty, 100, or 200. In another such example, comparator 140 is configured to produce detection indication I10 to have the first state if difference energy value V10 is greater than (alternatively, not less than) threshold value T1 for q of the most recent p frames and to have the second state otherwise. In such case, the value of q may be a proportion in the range of from about fifty or sixty percent to about seventy-five, eighty, ninety, 95, or 99 percent.

It may be desirable to configure comparator 140 (or comparator 142) to produce detection indication I10 to have more than two states. For example, it may be desirable for detection indication I10 to have three or four possible states, or 16 or 256 or more possible states (e.g., to be a four-bit, eight-bit, ten-bit, 12-bit, or 16-bit value), or any number of states in between. In such case, the various states may be considered to represent different relative intensities of the uncorrelated component. In one example, a binary value obtained as described above (e.g., according to a relation between value V10 and threshold value T1) is converted to a multi-state value by applying a smoothing algorithm such as $M_{sc}=(1-\gamma)B+\gamma M_{sp}$, where B is the binary value calculated for the current frame, $M_{sp}$ is the previous smoothed value, $M_{sc}$ is the current smoothed value, and $\gamma$ is a smoothing factor having a value in the range of from zero (no smoothing) to about 0.999 (maximum smoothing). In another example, a multi-state value is obtained based on the proportion of the most recent w frames for which a binary value obtained as described above (e.g., according to a relation between value V10 and threshold value T1) has had the first state, where the value of w may be in the range of from about ten or twenty to about fifty, 100, or 200.

Alternatively, comparator 140 may be configured to produce detection indication I10 having more than two states by applying a mapping function to instances of difference energy value V10 (e.g., as normalized by an energy of first channel S10*b* as described above). It may be desirable for the mapping function to be based on threshold value T1 as described above and to have a sigmoid shape over the range of possible values of difference energy value V10. Examples of mapping functions that may be used in such cases include the following:

$$\text{sigmoid}(x) = \frac{1}{1+\exp(-c(x-T1))};$$

$$\text{simplex}(x) = \begin{cases} 1, & x \geq T1+\varepsilon \\ \dfrac{x-T1}{2\varepsilon}+0.5, & T1-\varepsilon > x > T1+\varepsilon \\ 0 & \text{otherwise;} \end{cases}$$

$$f(x) = \frac{c(x-T1)}{1+c(x-T1)};$$

$$g(x) = \begin{cases} 1-\exp[-c(x-T1)], & x > T1 \\ 0, & \text{otherwise;} \end{cases}$$

$$h(x) = \frac{1-\exp(-c(x-T1))}{1+\exp(-c(x-T1))}.$$

Figure 12:
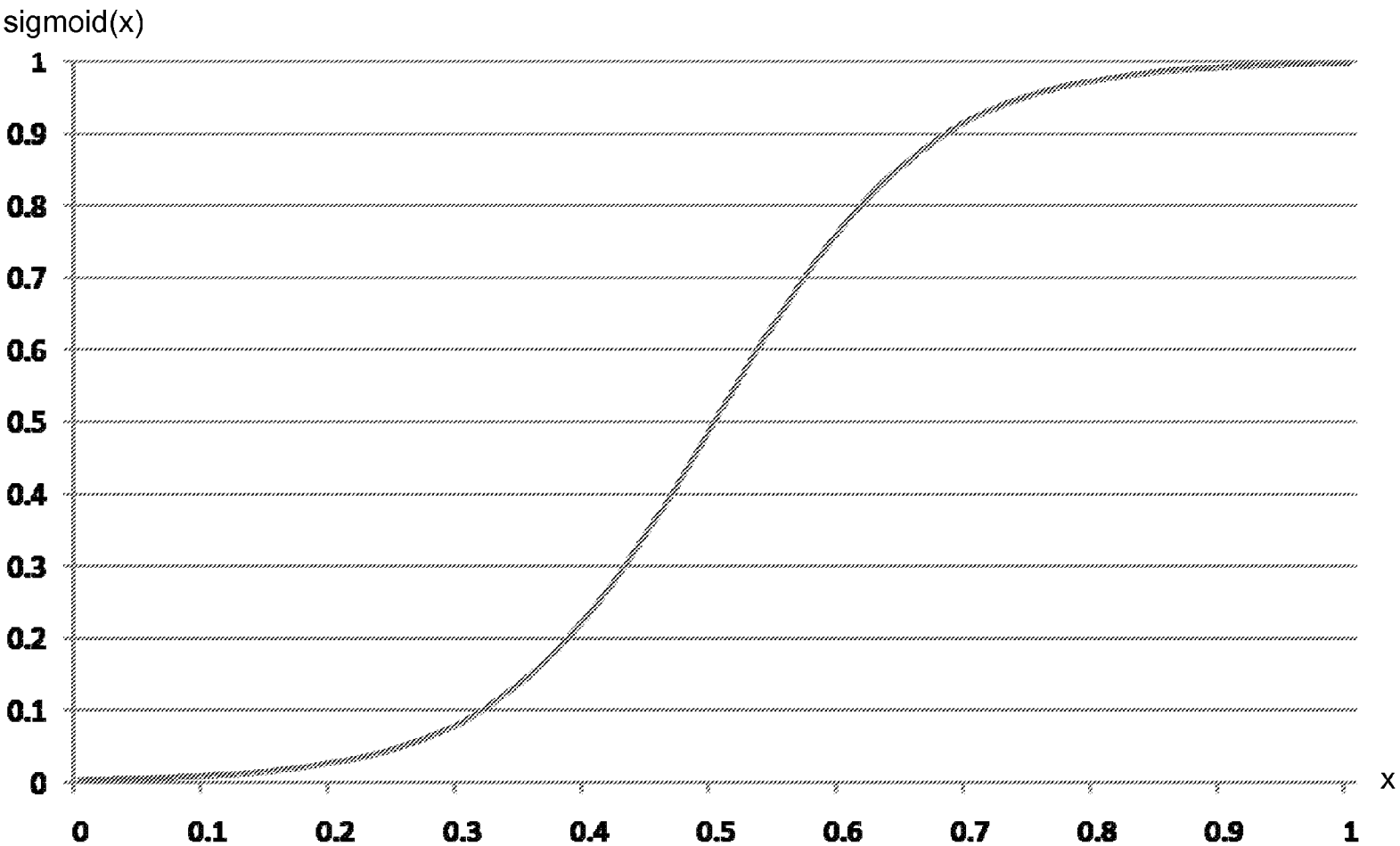
FIG. 12 shows a plot of a mapping function h(x).

It will be understood that the function h(x) as set forth above is related to the hyperbolic tangent function. Other possible examples of mapping functions include functions based on the inverse tangent function. FIG. 12 shows a plot of the function sigmoid(x) as set forth above over the range of x=0 to x=1. In this example, the scale factor c has the value 12 and threshold value T1 has the value 0.5.

A multi-state detection indication I10 (e.g., as returned by a mapping function, and possibly after a smoothing operation as described above) may be used to control mixing of spatially processed and single-channel signals. For example, it may be desirable to mix the signals to include a higher proportion of the spatially processed signal when the relative intensity of the uncorrelated component is low, and to include a higher proportion of the single-channel signal (e.g., first channel S10*a*) when the relative intensity of the uncorrelated component is high. Such a mixing operation may be implemented, for example, using any of the spatial processing stages shown in FIGS. 7A, 7B, 8A, and 8B, with selector SL10 being replaced with a mixer.

Figure 13A:
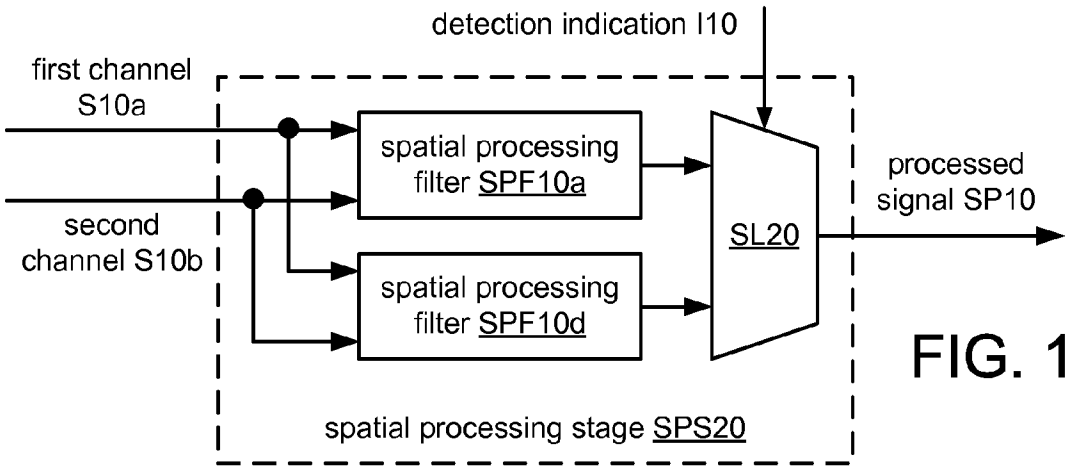
FIG. 13A shows a block diagram of an implementation SPS20 of spatial processing stage SPS10.

Alternatively, such a multi-state signal may be used to select from among different spatial processing filters. FIG. 13A shows an example of such an implementation SPS20 of spatial processing stage SPS10, in which selector SL20 is configured to select from among the outputs of implementations SPF10*a* and SPF10*d* of filter SPF10 according to the value of detection indication I10. In this example, filter SPF10*d* is configured to be less directional (and consequently less sensitive to uncorrelated noise) than filter SPF10*a*, and selector SL20 is configured to select the output of filter SPF10*d* when detection indication I10 indicates a high relative intensity of an uncorrelated component and to select the output of filter SPF10*a* otherwise.

Alternatively or additionally, a multi-state detection indication I10 may be used to select among different bandpass filters, or to vary the cutoff frequency and/or rolloff characteristic of a bandpass filter, to obtain an appropriately aggressive degree of noise removal. Such filters may be used to selectively attenuate one or more bands of first channel S10*a* and/or of second channel S10*b*. In one such example, a high-pass filter is controlled to have a cutoff frequency ranging from a low of about fifty to about one hundred Hz when detection indication I10 indicates a low relative intensity of an uncorrelated component to a high of about 800 to 1000 Hz when detection indication I10 indicates a high relative intensity of an uncorrelated component. It may be desirable to perform a spatial processing operation (e.g., using an implementation of spatial processing stage SPS10 as described herein) on the channels S10*a* and S10*b* after such filtering.

Figure 13B:
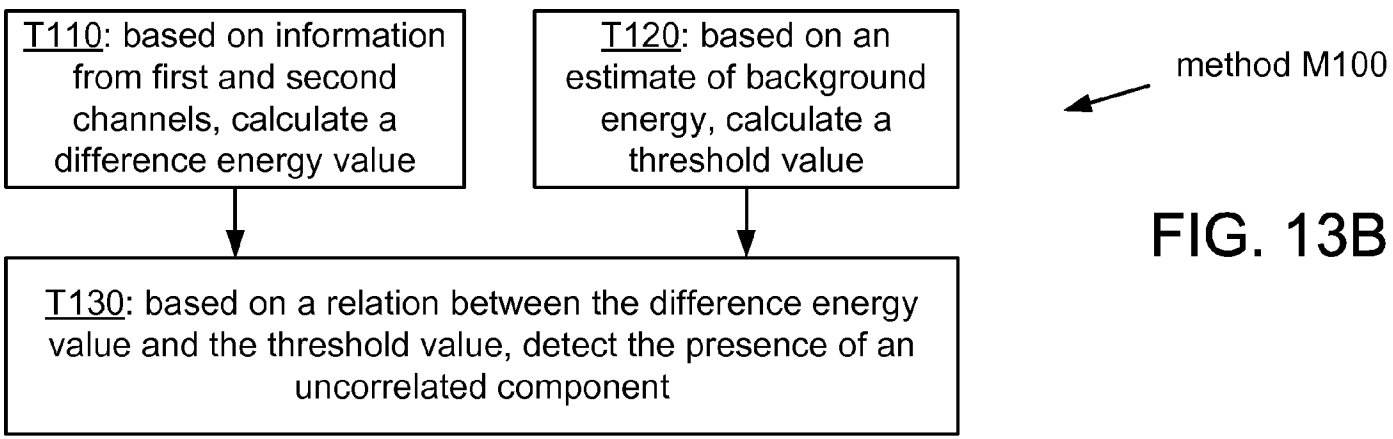
FIG. 13B shows a flowchart of a method M100 according to a general configuration.
Figure 18A:
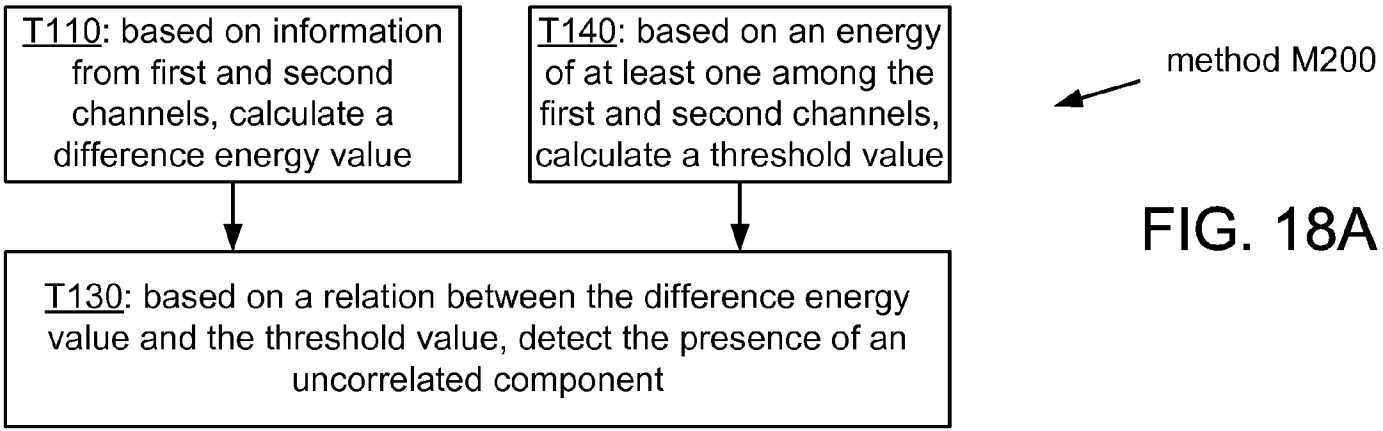
FIG. 18A shows a flowchart of a method M200 according to a general configuration.

FIG. 13B shows a flowchart of a method M100 according to a general configuration that includes tasks T100, T200, and T300. Based on information from the first and second channels, task T100 calculates a difference energy value. Based on an estimate of background energy, task T120 calculates a threshold value. Based on a relation between the difference energy value and the threshold value, task T130 detects the presence of a component that is substantially uncorrelated between the first and second channels. In this context, a component that is "substantially uncorrelated between the first and second channels" indicates that a normalized correlation of the component between the two channels (e.g., at zero lag) is not greater than about zero point two (0.2). FIG. 18A shows a flowchart of a method M200 according to another general configuration that includes task T140 instead of task T120. Task T140 calculates a threshold value that is based on an energy of at least one among the first channel and the second channel.

For a case in which multi-channel signal S100 has more than two channels (e.g., array R10 includes more than two microphones), an implementation of apparatus A100 may be applied to each pair of channels, and the various detection indications I10 may be compared in order to determine which microphone is receiving the uncorrelated noise component. For such an example that includes three microphones A, B, and C, implementations of apparatus A100 may be applied to the channels from each microphone pair AB, AC, and BC. If the detection indications from two of these pairs indicate the presence of uncorrelated noise, but the detection indication from the other does not, it may be assumed that the microphone common to the two corrupted pairs is the one receiving the uncorrelated component. The channel from this microphone may then be excluded from a spatial processing stage and/or may be filtered to attenuate the uncorrelated component.

Figure 15:
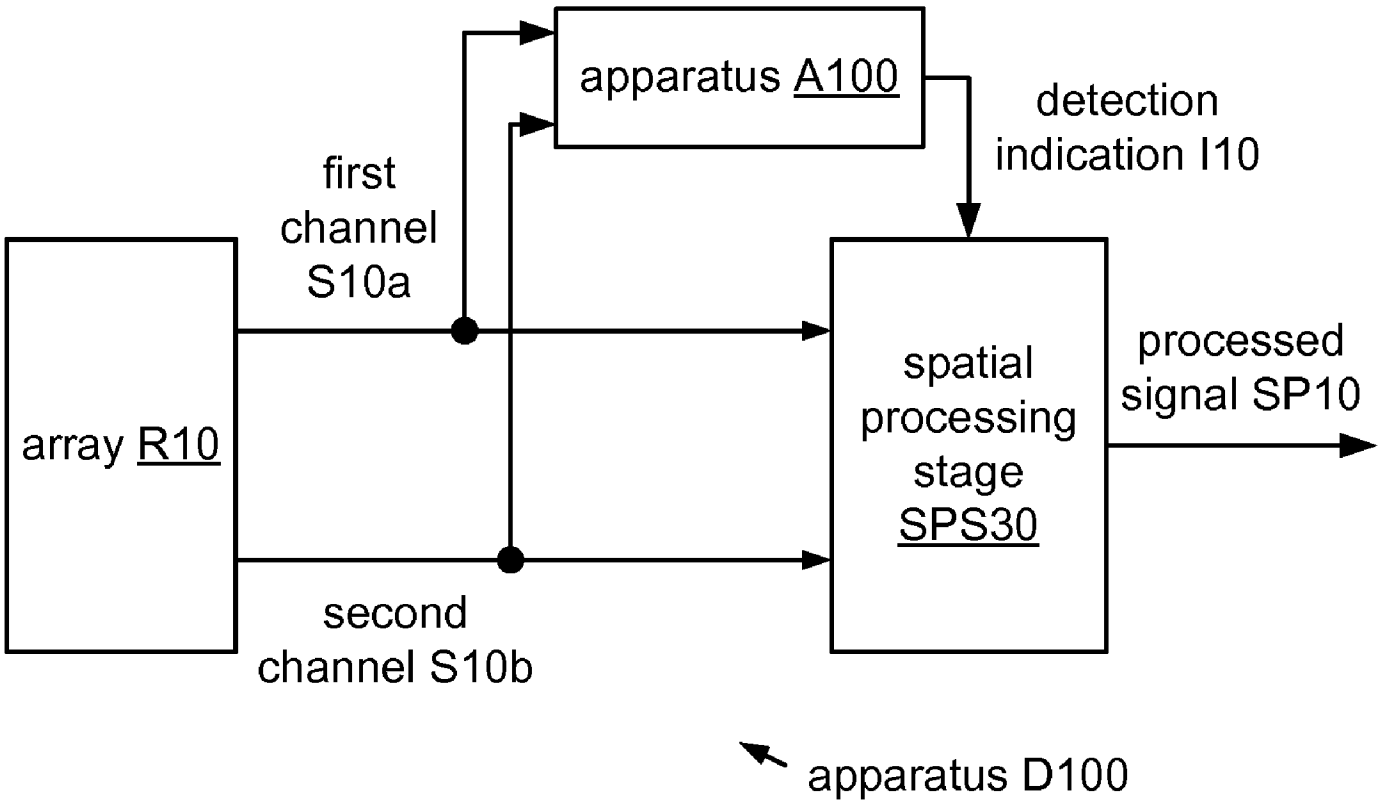
FIG. 15 shows a block diagram of an apparatus D100 according to a general configuration.

FIG. 15 shows a block diagram of an apparatus D100 according to a general configuration. Apparatus D100 includes implementations of array R10 and apparatus A100 according to any of the examples described herein. Apparatus D100 also includes an implementation SPS30 of spatial processing stage SPS10 that is configured to select between a single-channel signal and a spatially processed signal based on a state of detection indication I10. For example, spatial processing stage SPS30 may be implemented using any of the implementations SPS12, SPS14, SPS16, and/or SPS18 as described herein. Apparatus D100 may be included within a hearing aid, an audio recording device, or a device for portable voice communications. For example, apparatus D100 may be used in place of device D10 in any of the example devices shown in FIGS. 2A-5.

Figure 16:
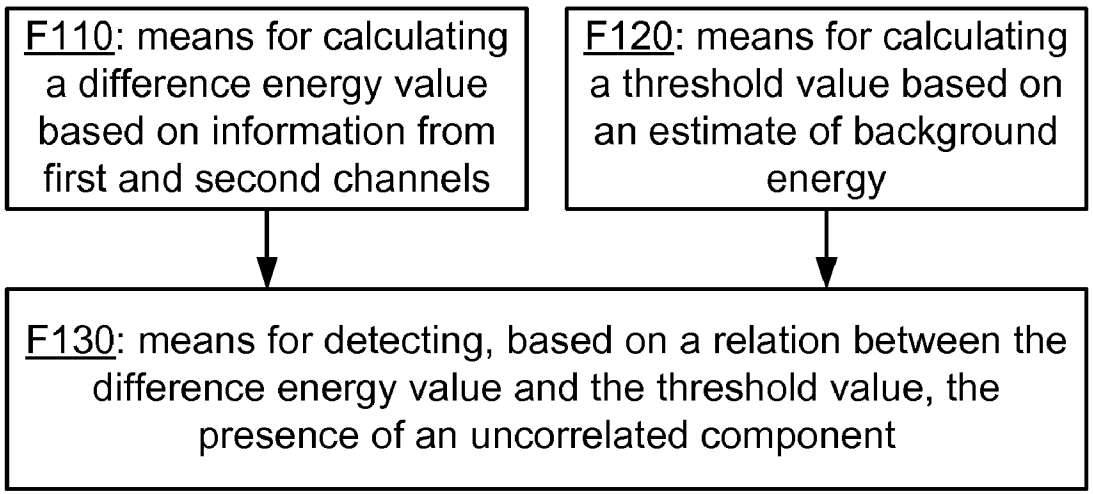
FIG. 16 shows a block diagram of an apparatus MF100 according to a general configuration.
Figure 18B:
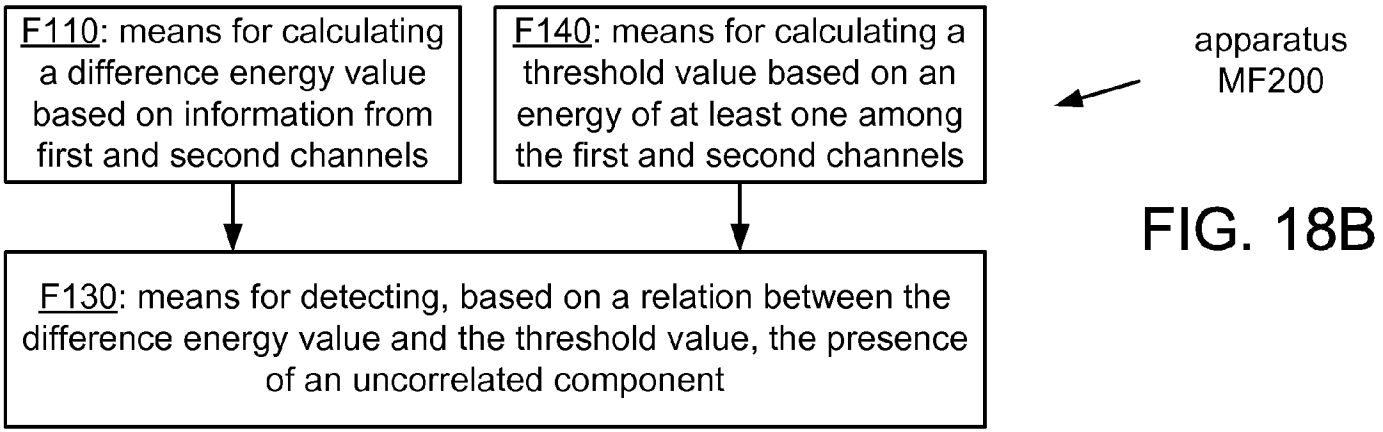
FIG. 18B shows a block diagram of an apparatus MF200 according to a general configuration.

FIG. 16 shows a block diagram of an apparatus MF100 that is configured to process a multi-channel acoustic signal. Apparatus MF100 includes means F110 for calculating a difference energy value based on information from first and second channels of the acoustic signal (e.g., as described above with reference to task T110 and various implementations of energy calculator 130). Apparatus MF100 also includes means F120 for calculating a threshold value based on an estimate of background energy of the acoustic signal (e.g., as described above with reference to task T120 and various implementations of threshold value calculator 160). Apparatus MF100 also includes means F130 for detecting, based on a relation between the difference energy value and the threshold value, the presence in the acoustic signal of a component that is substantially uncorrelated among the first and second channels (e.g., as described above with reference to task T130 and various implementations of comparator 140). FIG. 18B shows a block diagram of an apparatus MF200 according to another general configuration that includes means F140 instead of means F120. Means F140 calculates a threshold value that is based on an energy of at least one among the first channel and the second channel (e.g., as described above with reference to task T140 and various implementations of threshold value calculator 160).

Figure 17:
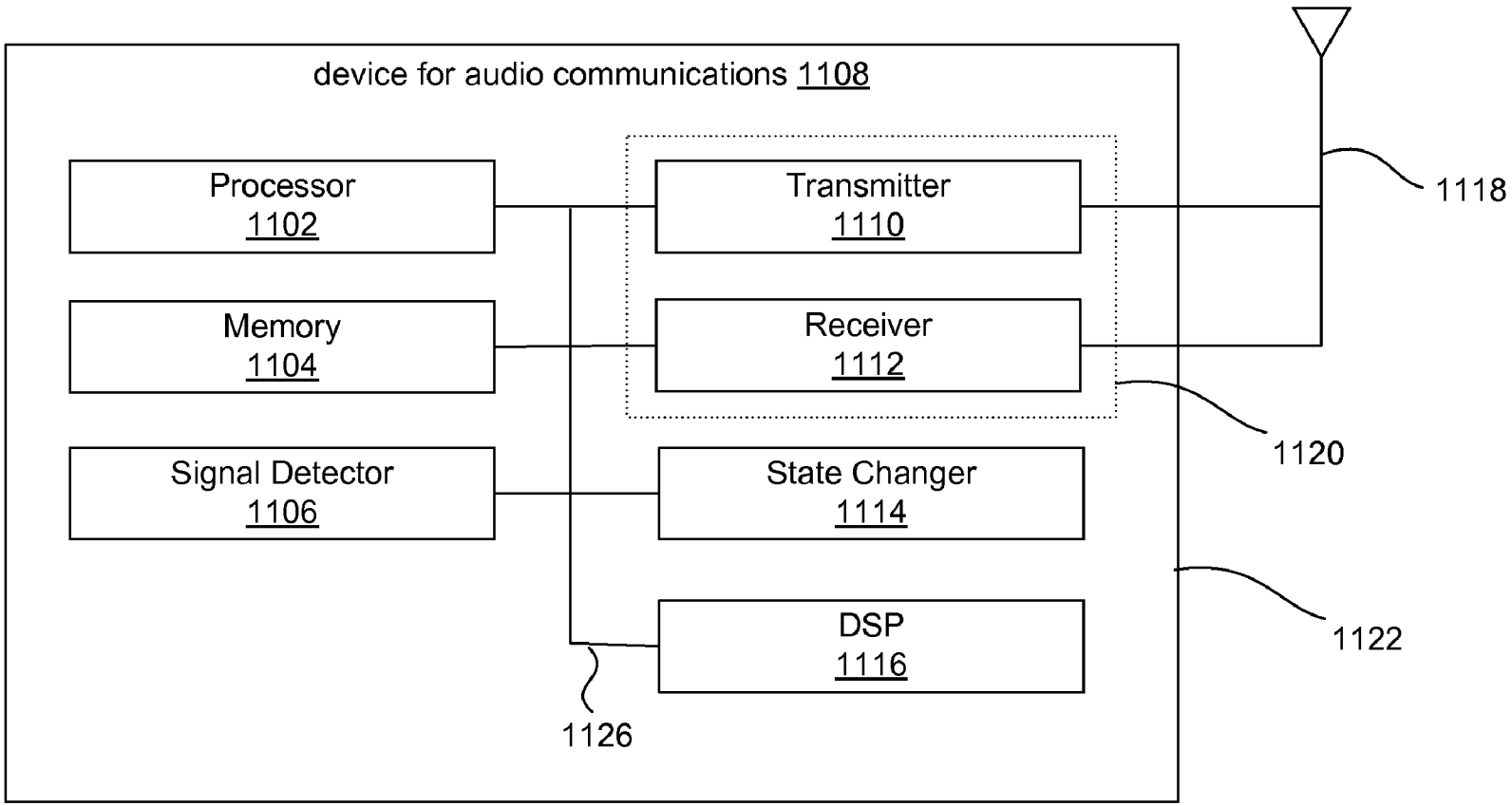
FIG. 17 shows a block diagram of a device for audio communications 1108 according to a general configuration.

FIG. 17 shows a block diagram of one example of a device for audio communications 1108 (e.g., a cellular telephone handset) that may be used as an access terminal with a telephony system as described herein. Device 1108 may be configured to include an implementation of apparatus A100, A200, or D100 as described herein. Device 1108 includes a processor 1102 configured to control operation of device 1108. Processor 1102 may be configured to control device 1108 to perform a method of processing a multi-channel acoustic signal as described herein. Device 1108 also includes memory 1104 that is configured to provide instructions (e.g., defining a method of processing a multi-channel acoustic signal as described herein) and data to processor 1102 and may include ROM, RAM, and/or NVRAM. Device 1108 also includes a housing 1122 that contains a transceiver 1120. Transceiver 1120 includes a transmitter 1110 and a receiver 1112 that support transmission and reception of data between device 1108 and a remote location. An antenna 1118 of device 1108 is attached to housing 1122 and electrically coupled to transceiver 1120.

Device 1108 includes a signal detector 1106 configured to detect and quantify levels of signals received by transceiver 1120. For example, signal detector 1106 may be configured to calculate values of parameters such as total energy, pilot energy per pseudonoise chip (also expressed as Eb/No), and/or power spectral density. Device 1108 includes a bus system 1126 configured to couple the various components of device 1108 together. In addition to a data bus, bus system 1126 may include a power bus, a control signal bus, and/or a status signal bus. Device 1108 also includes a digital signal processor (DSP) 1116 configured to process signals received by and/or to be transmitted by transceiver 1120. For example, DSP 1116 may be configured to receive a multi-channel acoustic signal from an instance of array R10 included with device 1106 (not shown). Processor 1102 and/or DSP 1116 (which may be considered in the context of this application as a single "processor") may also be configured to decode and reproduce encoded audio or audiovisual media stored in memory 1104 (e.g., MP3, MP4, AAC (Advanced Audio Codec), or WMA/WMV (Windows Media Audio/Video) files). In this example, device 1108 is configured to operate in any one of several different states and includes a state changer 1114 configured to control a state of device 1108 based on a current state of the device and on signals received by transceiver 1120 and detected by signal detector 1106.

The present disclosure relates to a system and method for detecting the presence of wind noise in acoustic signal recordings. The method includes a pre-processing module (e.g., including bandpass filters 110*a* and 110*b*, and possibly gain matching module 150, as described herein) in which signals are band passed and microphone sensitivities are matched. Then it is followed by a detection module (e.g., including difference signal calculator 120, energy calculator 130, and comparator 140 as described herein) where pressure gradient is computed and compared to an adaptive threshold.

Use of multiple microphones on audio devices has recently gained increased popularity. These devices include mobile phone handsets, wired or wireless headsets, car-kits, hands free speakerphones, hand held PDAs, and laptop computers. Multiple microphones are installed on these devices mainly for improved noise reduction of the send signal. Noise reduction using multiple microphones is achieved typically by beamforming techniques. A "beam" is created by applying filters to the microphone signals and aimed at the desired signal source. Signal pickup from outside the beam direction is minimized and acoustic noise reduction is achieved. In other words, effectively a directional microphone is created by filtering and summing the signal from the individual microphones.

One major drawback for the beamforming techniques is that uncorrelated noises in the individual input channels tend to be amplified after the beamforming processing. This is particularly true for low frequency noises. Circuit noise, noise caused by a device user touching the microphones, and noise caused by wind turbulence at the microphones are the major sources of uncorrelated noises. Of these sources, wind turbulence noise may be the most troublesome because of its low frequency nature. Wind noise at the output of the beamforming filters can be amplified by more than five times as compared to the input. A wind noise detection mechanism may be desirable to identify the presence of wind noise and to process the wind noise with dedicated modules.

A wind noise detection scheme described in the present disclosure comprises three basic stages. In the first stage, the input signals are low-passed and may be gain adjusted to have matched input energy. In the next stage, a difference signal is computed and frame energy is obtained. In the last stage, this frame energy is then compared to an adaptive threshold to decide if wind noise is present.

A wind noise detection scheme described in this disclosure is targeted for devices with multiple microphones. For simplicity, we first assume that the device has two microphones. Since wind noise is low frequency in nature, the input signals are first lowpass filtered to better isolate the wind noise from other signal. Next the secondary channel signal is gain adjusted such that a far-field acoustic source would result in equal signal amplitude in both channels. The required gain for such adjustment can be obtained offline or in real-time through some automatic gain matching mechanism.

A wind detection scheme as described herein has been applied to an example signal recorded from a device having two microphones. A mixture of human speech, wind noise and road noise was recorded in which the wind noise was similarly strong in both microphones and as strong as the human speech. The talker was closer to the first microphone while the far-field road noise was equally loud in both microphones. Road noise is also of low frequency in characteristic and often confuses single-microphone based wind noise detectors. The scheme correctly detected the wind noise while rejecting the low-frequency road noise.

Although the current scheme describes the detection of wind noise using a two-microphone input or one directional microphone input (see below), it would be understood that the scheme can be extended and applied to signals of any kinds to detect uncorrelated noise and generalized to signals of multiple input channels.

Figure 14A:
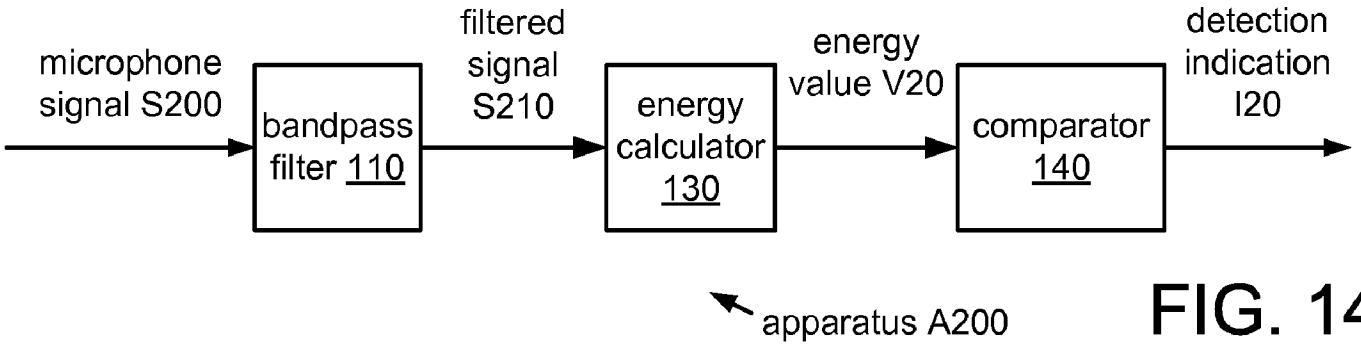
FIG. 14A shows a block diagram of an apparatus A200 according to another configuration.
Figure 14B:
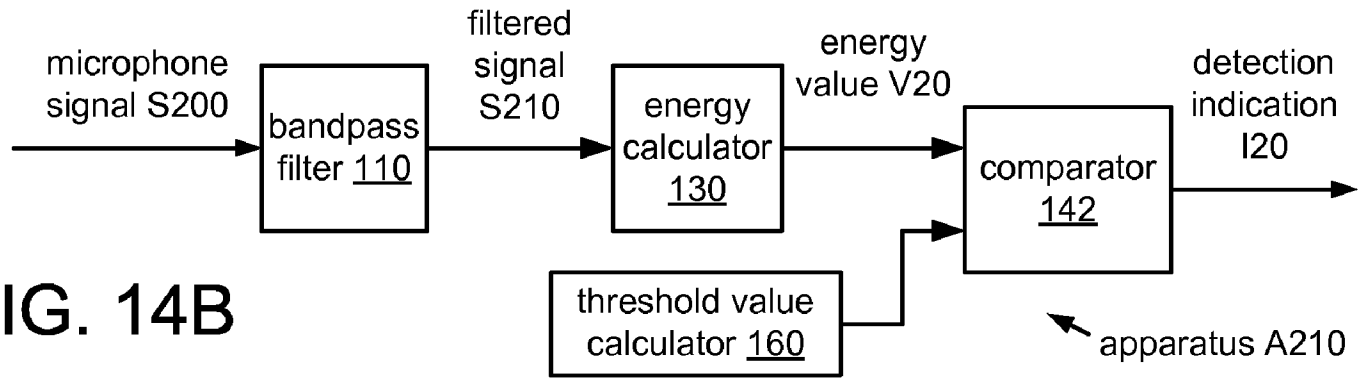
FIG. 14B shows a block diagram of an implementation A210 of apparatus A200.

FIG. 14A shows a block diagram of an apparatus A200 according to another configuration that may be included, for example, in an implementation of device D10. In this example, bandpass filter 110 receives a microphone signal S200 that is based on a signal as sensed by a directional microphone and produces a corresponding filtered signal S210. The directional microphone may be part of an array R10 as described herein, and/or microphone signal S200 may be processed in a similar manner as described above for channels S10*a*, S10*b*. Bandpass filter 110 may be configured according to any of the implementations of filters 110*a*, 110*b* described herein. Energy calculator 130 receives filtered signal S210 and calculates a corresponding energy value V20 (e.g., as described above with reference to difference energy value V10). Comparator 140 produces a detection indication I20, indicating presence or absence of an uncorrelated component, that is based on a relation between a threshold value T1 and energy value V20. Threshold value T1 may be based on an estimate of background energy as described above (e.g., with the energy value V20 being used to update the estimate in place of difference energy value V10 as described herein). In this example, the directional microphone may be positioned to measure a pressure gradient in the surrounding air as caused by an acoustic source. Typically such a directional microphone is implemented to include a single sensor and two or more defined ports that open externally in different directions, such that the sensor receives sound energy essentially only from the directions in which the ports face. The microphone may include a cavity or other acoustic mixing structure between the ports and the sensor, such that the sound energy incident on the sensor is a difference of the sound energies received through the various ports (e.g., such that a signal received equally via the various ports is canceled before reaching the sensor). FIG. 14B shows a block diagram of an implementation A210 of apparatus A200 that includes an implementation of threshold value calculator 160 and comparator 142 as described herein. Apparatus D100 as shown in FIG. 15 may also be configured to include an implementation of apparatus A200 in place of apparatus A100.

The range of disclosed configurations includes apparatus and methods of separating an acoustic signal from a mixture of acoustic signals (e.g., using one or more spatial processing operations). In a telephony application of such a device, the separated acoustic signal may be the voice of the user of the device. The range of disclosed configurations also includes apparatus and methods of controlling a highpass filter to remove a detected uncorrelated noise component (e.g., wind noise). The present disclosure further describes a switching mechanism stage that selects parameter sets for a fixed filtering stage (and possibly for subsequent processing stages) based on the current state of detection indication I10 (e.g., according to an implementation of stage SPS20 as shown in FIG. 13A) and/or on the currently identified user-handset orientation. The fixed filtering stage may be followed by an adaptive blind-source separation or combined beamforming filtering stage (e.g., as discussed above with reference to FIG. 8A).

Applications of a BSS method as described herein may include the implementation of at least one of independent component analysis (ICA), independent vector analysis (IVA), constrained ICA, or constrained IVA. These methods typically provide relatively accurate and flexible means for the separation of speech signals from noise sources. Independent component analysis is a technique for separating mixed source signals (components) which are presumably independent from each other. In its simplified form, ICA operates an "un-mixing" matrix of weights on the mixed signals (for example, multiplying the matrix with the mixed signals) to produce separated signals. The weights are assigned initial values, and then adjusted to maximize joint entropy of the signals in order to minimize information redundancy. This weight-adjusting and entropy-increasing process is repeated until the information redundancy of the signals is reduced to a minimum. Independent vector analysis is a related technique wherein the source signal is a vector source signal instead of a single variable source signal. Because these techniques do not require information on the source of each signal, they are known as "blind source separation" methods. Directional constraints of varying degrees may be combined with such algorithms to obtain constrained ICA and constrained IVA methods. Blind separation problems refer to the idea of separating mixed signals that come from multiple independent sources.

Another widely known technique for linear microphone-array processing is often referred to as "beamforming". Beamforming techniques use the time difference between channel that results from the spatial diversity of the microphones to enhance a component of the signal that arrives from a particular direction. More particularly, it is likely that one of the microphones will "look" more directly at the desired source (e.g., the user's mouth), whereas the other microphone may generate a signal from this source that is relatively attenuated. These beamforming techniques are methods for spatial filtering that steer a beam towards a sound source, putting a null at the other directions. Beamforming techniques make no assumption on the sound source but assume that the geometry between source and sensors, or the sound signal itself, is known for the purpose of dereverberating the signal or localizing the sound source.

A well studied technique in robust adaptive beamforming referred to as "Generalized Sidelobe Canceling" (GSC) is discussed in Hoshuyama, O., Sugiyama, A., Hirano, A., A Robust Adaptive Beamformer for Microphone Arrays with a Blocking Matrix using Constrained Adaptive Filters, IEEE Transactions on Signal Processing, vol. 47, No. 10, pp. 2677-2684, October 1999. Generalized sidelobe canceling aims at filtering out a single desired source signal from a set of measurements. A more complete explanation of the GSC principle may be found in, e.g., Griffiths L. J., Jim, C. W., An alternative approach to linear constrained adaptive beamforming, IEEE Transactions on Antennas and Propagation, vol. 30, no. 1, pp. 27-34, January 1982.

Although BSS algorithms can address complex separation problems by evaluating higher order statistical signal properties, the filter solutions may be slow to converge. Therefore it may be desirable to learn a converged BSS filter solution during a design or calibration phase (e.g., using one or more sets of training data) and to implement the solution at run-time as a set of fixed filter coefficients. It may also be desirable to obtain converged BSS filter solutions for different expected orientations of the device (e.g., the handset) to the user's mouth (e.g., based on a sufficiently rich variety of training data) and to use a switching stage at run-time that decides which converged fixed filter set corresponds best to the present user-device orientation. The blind-source separation method may include the implementation of at least one of Independent Component Analysis (ICA), Independent Vector Analysis (IVA), constrained ICA, or constrained IVA. Learning rules and adaptive schemes can be implemented in the offline analysis, and such analysis can include processes based on ICA or IVA adaptive feedback and feedforward schemes as outlined in Patent Applications "System and Method for Advanced Speech Processing using Independent Component Analysis under Explicit Stability Constraints", U.S. Prov. App. No. 60/502,523, U.S. Prov. App. No. 60/777,920—"System and Method for Improved Signal Separation using a Blind Signal Source Process", U.S. Prov. App. No. 60/777,900—"System and Method for Generating a Separated Signal" as well as Kim et al., "Systems and Methods for Blind Source Signal Separation".

Some configurations of methods and apparatus as disclosed herein include applying an adaptive or a partially adaptive filter to the fixed coefficient filtered signals to produce a separated signal (e.g., as discussed above with reference to FIG. 8A). Applying the adaptive or the partially adaptive filter can, in some configurations, separate the fixed coefficient filtered signals into output signals, wherein at least one output signal contains a desired signal with distributed background noise and at least one other signal contains interfering source signals and distributed background noise. The present disclosure also describes a post processing stage (e.g., a noise reduction filter) which reduces the noise in the noisy desired speaker signal based on the noise reference provided by the separated interfering source and distributed background signals (e.g., as discussed above with reference to FIG. 7B). Such a method may also be implemented to include tuning of parameters, selection of initial conditions and filter sets, and/or transition handling between sets for all noise separation or reduction stages by the switching mechanism stage, which bases its decisions on the currently identified user-handset orientation. The method may further comprise applying echo cancellation. Finally the presented system tuning may depend on the nature and settings of the handset baseband chip or chipset, and/or on network effects, to optimize overall noise reduction and echo cancellation performance.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

The various elements of an implementation of an apparatus as described herein may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of an apparatus as described herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of apparatus A100 or A200 may also be embodied as one or more computers (e.g., machines including one or more arrays programmed to execute one or more sets or sequences of instructions, also called "processors"), and any two or more, or even all, of these elements may be implemented within the same such computer or computers.

Those of skill will appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods described herein may be performed by a array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a computer-readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit (e.g., an integrated circuit), a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements such as semiconductor memory (which may include without limitation dynamic or static RAM, ROM, EEPROM, and/or flash RAM), or ferroelectric, magnetoresistive, ovonic, polymeric, phase-change memory; CD-ROM or other optical disk storage; magnetic disk storage or other magnetic storage devices; or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.) where disks usually reproduce data magnetically, while discs reproduce data optically with lasers. Combinations of the above should also be included within the scope of computer-readable media.

In a typical application of an implementation of a method as described herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more computer-readable media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as described herein may also be performed by more than one such array or machine. In these or other implementations, at least some of the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive encoded frames.

It is expressly disclosed that the various methods described herein may be performed at least in part by a portable communications device such as a handset, headset, or portable digital assistant (PDA), and that the various apparatus described herein may be included within such a device. A typical real-time (e.g., online) application is a telephone conversation conducted using such a mobile device.

An acoustic signal processing apparatus as described herein may be incorporated into an electronic device that accepts speech input in order to control certain functions, or otherwise requires separation of desired noises from background noises, such as communication devices. Many applications require enhancing or separating clear desired sound from background sounds originating from multiple directions. Such applications may include human-machine interfaces in electronic or computational devices which incorporate capabilities such as voice recognition and detection, speech enhancement and separation, voice-activated control, and the like. It may be desirable to implement such an acpistic signal processing apparatus to be suitable in devices that only provide limited processing capabilities.

The elements of the various implementations of the modules and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times). For example, bandpass filters 110*a* and 110*b* may be implemented to include the same structure at different times.

What is claimed is:

1. A method of processing a multi-channel acoustic signal, said method comprising:

based on information from a first channel of the acoustic signal and a second channel of the acoustic signal, calculating a difference energy value;

based on an estimate of background energy of at least one channel of the multi-channel acoustic signal, calculating a threshold value; and based on a comparison relation between the difference energy value and the threshold value, detecting the presence in the multi-channel acoustic signal of a component that is substantially uncorrelated among the first and second channels.

2. The method according to claim 1, wherein the difference energy value is based on an energy of a difference signal, and wherein the difference signal is a sequence of differences between (A) samples of a signal based on the first channel and (B) corresponding samples of a signal based on the second channel.

3. The method according to claim 1, wherein said method includes performing a gain matching operation, based on information from the first channel, on the second channel to obtain a gain-matched signal, wherein said difference energy value is based on information from the gain-matched signal.

4. The method according to claim 1, wherein said method includes performing a bandpass filtering operation on each of the first and second channels to obtain a first filtered signal and a second filtered signal, respectively, and wherein said difference energy value is based on information from the first and second filtered signals.

5. The method according to claim 1, wherein said method includes updating the estimate of background energy based on a comparison relation between (A) a difference energy value and (B) a current value of the estimate.

6. The method according to claim 1, wherein said detecting includes indicating a relative intensity of the substantially uncorrelated component.

7. The method according to claim 1, wherein said method includes, based on said detecting, selecting one among (A) the first channel of the multi-channel acoustic signal and (B) a spatially processed signal that is based on information from both of the first and second channels of the multi-channel acoustic signal.

8. The method according to claim 7, wherein said method includes transmitting, to a wireless telephony communication system, a signal that is based on the selected one among (A) the first channel of the multi-channel acoustic signal and (B) the spatially processed signal.

9. A computer-readable medium comprising instructions which when executed by a processor cause the processor to process a multi-channel acoustic signal by:

calculating a difference energy value based on information from a first channel of the acoustic signal and a second channel of the acoustic signal;

calculating a threshold value based on an estimate of background energy of at least one channel of the multi-channel acoustic signal; and detecting, based on a comparison relation between the difference energy value and the threshold value, the presence in the multi-channel acoustic signal of a component that is substantially uncorrelated among the first and second channels.

10. The computer-readable medium according to claim 9, wherein said instructions which when executed by a processor cause the processor to calculate the difference energy value include instructions which when executed by a processor cause the processor to calculate the difference energy value based on an energy of a difference signal, and wherein said medium comprises instructions which when executed by a processor cause the processor to calculate the difference signal as a sequence of differences between (A) samples of a signal based on the first channel and (B) corresponding samples of a signal based on the second channel.

11. The computer-readable medium according to claim 9, wherein said medium includes instructions which when executed by a processor cause the processor to perform a gain matching operation, based on information from the first channel, on the second channel to obtain a gain-matched signal, wherein the difference energy value is based on information from the gain-matched signal.

12. The computer-readable medium according to claim 9, wherein said medium includes instructions which when executed by a processor cause the processor to perform a bandpass filtering operation on each of the first and second channels to obtain a first filtered signal and a second filtered signal, respectively, and wherein the difference energy value is based on information from the first and second filtered signals.

13. The computer-readable medium according to claim 9, wherein said medium includes instructions which when executed by a processor cause the processor to update the estimate of background energy based on a comparison relation between (A) a difference energy value and (B) a current value of the estimate.

14. The computer-readable medium according to claim 9, wherein said instructions which when executed by a processor cause the processor to detect include instructions which when executed by a processor cause the processor to indicate a relative intensity of the substantially uncorrelated component.

15. The computer-readable medium according to claim 9, wherein said medium includes instructions which when executed by a processor cause the processor to select, based on an outcome of said instructions which when executed by a processor cause the processor to detect, one among (A) the first channel and (B) a spatially processed signal that is based on information from both of the first and second channels.

16. The computer-readable medium according to claim 15, wherein said medium includes instructions which when executed by a processor cause the processor to control a transmitter to transmit, to a wireless telephony communication system, a signal that is based on the selected one among (A) the first channel and (B) the spatially processed signal.

17. An apparatus for processing a multi-channel acoustic signal, said apparatus comprising:

means for calculating a difference energy value based on information from a first channel of the acoustic signal and a second channel of the acoustic signal;

means for calculating a threshold value based on an estimate of background energy of at least one channel of the multi-channel acoustic signal; and means for detecting, based on a comparison relation between the difference energy value and the threshold value, the presence in the multi-channel acoustic signal of a component that is substantially uncorrelated among the first and second channels.

18. The apparatus according to claim 17, wherein the difference energy value is based on an energy of a difference signal, and wherein said apparatus includes means for calculating the difference signal as a sequence of differences between (A) samples of a signal based on the first channel and (B) corresponding samples of a signal based on the second channel.

19. The apparatus according to claim 17, wherein said apparatus includes means for performing a gain matching operation, based on information from the first channel, on the second channel to obtain a gain-matched signal, wherein the difference energy value is based on information from said gain-matched signal.

20. The apparatus according to claim 17, wherein said apparatus includes means for performing a bandpass filtering operation on each of the first and second channels to obtain a first filtered signal and a second filtered signal, respectively, and wherein the difference energy value is based on information from the first and second filtered signals.

21. The apparatus according to claim 17, wherein said apparatus includes means for updating the estimate of background energy based on a comparison relation between (A) a difference energy value and (B) a current value of the estimate.

22. The apparatus according to claim 17, wherein said means for detecting includes means for indicating a relative intensity of the substantially uncorrelated component.

23. The apparatus according to claim 17, wherein said apparatus includes means for selecting, based on an output of said means for detecting, one among (A) the first channel and (B) a spatially processed signal that is based on information from both of the first and second channels.

24. The apparatus according to claim 23, wherein said apparatus includes means for transmitting, to a wireless telephony communication system, a signal that is based on the selected one among (A) the first channel and (B) the spatially processed signal.

25. The apparatus according to claim 23, wherein said apparatus includes a transmitter configured to transmit, to a wireless telephony communication system, a signal that is based on the selected one among (A) the first channel and (B) the spatially processed signal.

26. An apparatus for processing a multi-channel acoustic signal, said apparatus comprising:

a difference signal calculator configured to calculate a difference signal based on information from a first channel of the multi-channel acoustic signal and a second channel of the multi-channel acoustic signal;

an energy calculator configured to calculate a difference energy value based on information from the difference signal;

a threshold value calculator configured to calculate a threshold value based on an estimate of background energy of at least one channel of the multi-channel acoustic signal; and a comparator configured to indicate, based on a relation between the difference energy value and the threshold value, the presence in the multi-channel acoustic signal of a component that is substantially uncorrelated among the first and second channels.

27. The apparatus according to claim 26, wherein said apparatus includes a gain matching module configured to apply, to a signal based on the second channel, a gain factor that is based on information from the first channel to obtain a gain-matched signal, wherein the difference signal is based on information from the gain-matched signal.

28. The apparatus according to claim 26, wherein said apparatus includes a first bandpass filter configured to filter the first channel to obtain a first filtered signal and a second bandpass filter configured to filter the second channel to obtain a second filtered signal, and wherein the difference energy value is based on information from the first and second filtered signals.

29. The apparatus according to claim 26, wherein said apparatus includes a background energy estimate calculator configured to update the estimate of background energy based on a comparison relation between (A) a difference energy value and (B) a current value of the estimate.

30. The apparatus according to claim 26, wherein said comparator is configured to indicate a relative intensity of the substantially uncorrelated component.

31. The apparatus according to claim 26, wherein said apparatus includes a selector configured to select, based on an indication of said comparator, one among (A) the first channel and (B) a spatially processed signal that is based on information from both of the first and second channels.

32. A method of processing a multi-channel acoustic signal, said method comprising:

based on information from a first channel of the acoustic signal and a second channel of the acoustic signal, calculating a difference energy value;

based on an energy of at least one among the first channel and the second channel, calculating a threshold value; and based on a comparison relation between the difference energy value and the threshold value, detecting the presence in the multi-channel acoustic signal of a component that is substantially uncorrelated among the first and second channels.

33. The method according to claim 32, wherein said calculating a threshold value based on an energy of at least one among the first channel and the second channel comprises calculating the threshold value based on a function of said energy, wherein the function is at least one among a linear function, a polynomial function, and an exponential function of said energy.

* * * * *